US010213034B2

(12) United States Patent
Zhang et al.

(10) Patent No.: US 10,213,034 B2
(45) Date of Patent: Feb. 26, 2019

(54) VALVE ASSEMBLY FOR A DRINKING CUP AND A DRINKING CUP HAVING A VALVE ASSEMBLY

(71) Applicant: HANDI-CRAFT COMPANY, St. Louis, MO (US)

(72) Inventors: Xiangwen Zhang, Ellisville, MO (US); Douglas Hanneken, St. Louis, MO (US)

(73) Assignee: Handi-Craft Company, St. Louis, MO (US)

( * ) Notice: Subject to any disclaimer, the term of this patent is extended or adjusted under 35 U.S.C. 154(b) by 148 days.

(21) Appl. No.: 15/384,862

(22) Filed: Dec. 20, 2016

(65) Prior Publication Data

US 2017/0174400 A1 Jun. 22, 2017

Related U.S. Application Data

(60) Provisional application No. 62/270,291, filed on Dec. 21, 2015.

(51) Int. Cl.
*A47G 19/22* (2006.01)

(52) U.S. Cl.
CPC ..... *A47G 19/2272* (2013.01)

(58) Field of Classification Search
CPC ..... B65D 43/0231; B65D 47/2031; B65D 47/2018; B65D 47/06; B65D 51/16; B65D 51/165; B65D 2543/00049; B65D 2543/00092; B65D 2543/00296; B65D 2543/00351; B65D 2543/00527; B65D 2543/00537; B65D 2543/00972; A47G 19/2272
USPC .... 220/62.12, 62.14, 714, 717, 203.19, 303, 220/703; 222/481; 215/311, 387; 251/205
See application file for complete search history.

(56) References Cited

U.S. PATENT DOCUMENTS

2002/0033399 A1 3/2002 Manganiello et al.
2002/0179615 A1* 12/2002 Hakim ..... A47G 19/2272 220/714

(Continued)

OTHER PUBLICATIONS

International Search Report and Written Opinion for International Application No. PCT/US2016/067687, dated Mar. 2, 2017, 11 pages.

(Continued)

*Primary Examiner* — Fenn C Mathew
*Assistant Examiner* — Elizabeth J Volz
(74) *Attorney, Agent, or Firm* — Armstrong Teasdale LLP

(57) ABSTRACT

A lid assembly includes a closure member and a valve assembly. The closure member has a socket in fluid communication with a liquid passageway. The socket has a wall with a cutout therein. The valve assembly includes a plug adapted for insertion into the socket to form a seal between the socket and the plug. The plug has a base, a side wall, and an interior chamber cooperatively defined by the base and the side wall. A portion of the side wall of the plug with a minimum thickness is disposed adjacent the cutout when the plug is inserted into the socket. The seal formed between the plug and socket is selectively moveable from a sealed configuration to an unsealed configuration by vacuum pressure being applied to the interior chamber of the plug.

19 Claims, 32 Drawing Sheets

(56) References Cited

U.S. PATENT DOCUMENTS

| | | | | |
|---|---|---|---|---|
| 2010/0127006 | A1 | 5/2010 | Krammes et al. | |
| 2010/0294764 | A1 | 11/2010 | Kemper et al. | |
| 2011/0079601 | A1* | 4/2011 | Steininger ..... | A47G 19/2272 220/714 |

OTHER PUBLICATIONS

International Search Report and Written Opinion for PCT/US2016/067687 dated Mar. 2, 2017, 10 Pages.

* cited by examiner

VALVE ASSEMBLY FOR A DRINKING CUP AND A DRINKING CUP HAVING A VALVE ASSEMBLY

CROSS-REFERENCE TO RELATED APPLICATIONS

This patent application relates to and claims priority to U.S. provisional patent application Ser. No. 62/270,291 filed Dec. 21, 2015, which is hereby incorporated by reference in its entirety.

FIELD

The field of this disclosure relates generally to leak resistant drinking cups and more particularly to a valve assembly for a leak resistant drinking cup wherein the valve assembly is moveable between a sealed position and an unsealed position.

BACKGROUND

Leak resistant drinking cups are often adapted for use by young children (e.g., infants, toddlers, preschoolers) or people on the go (e.g., commuters, students, hikers, joggers). Usually, the cup includes a container defining an interior space for receiving and holding liquids therein. The container typically includes an open top, and the cup often includes a relatively rigid cover for closing the open top of the container. The cover can be releasably attached (e.g., snapped or screwed on) to the container. These types of drinking cups are often configured so that when they are turned over, liquid inside the cup is inhibited from spilling out of the cup by a valve or valve assembly.

The valve or valve assembly is typically disposed between the cover and the container and can be configured from a sealed configuration for inhibiting liquid from passing out of the drinking cup to an unsealed configuration for allowing liquid to pass out of the cup for drinking. Most commonly, the valve is actuated by suction (i.e., vacuum pressure) applied by the user to the interior of the cup by sucking on a part of the drinking cup (e.g., a spout, a straw). The applied vacuum pressure causes the valve to move or otherwise deform in such a way that a path past the valve is created so liquid can flow out of the cup. It is possible that the valve might be actuated in other ways, such as a purely mechanical actuation. But for young children, vacuum pressure actuation is often most preferable because the only time the valve is open is when the child is in the act of taking a drink.

Vacuum pressure actuated drinking cups of the type just described must balance the need to assure positive sealing with the need to make the cup easy to use. A strong seal by the valve requires greater vacuum pressure to open, making it difficult for the user to use. A valve having a seal that requires a lower vacuum pressure to open may not seal sufficiently tight to prevent at least some liquid flowing past it, especially when dropped, swung, shaken, or impacted. As a result, valves having low vacuum pressure actuated seals are often more prone to leak. Moreover, typical valves or valve assemblies include slits (or cuts) in the valve or valve assembly that allow liquid to flow through the valve or valve assembly during use of the cup. However, these slits often provide a pathway for liquid to potentially leak from the cup.

Frequently, conventional valves are relatively small and, as a result, often require a substantial vacuum pressure to actuate because the pressure acts on only a relatively small area of the valve. In other words, the user has to suck with significant effort to get the valve to open and obtain a drink, which makes the cup less desirable to the child.

Often, the valve or valve assembly can be disassembled from the cover for cleaning. Some valves and valve assemblies are difficult to detach and reassemble as they require precise alignment or orientation of relatively small parts or parts with small tolerances. Moreover, small valves or pieces of a valve assembly may be easily lost and are often difficult to handle.

There remains a need for a valve assembly and a leak resistant drinking cup with such a valve assembly that effectively inhibits liquid from leaking from the cup but can be readily actuated when subjected to vacuum pressure applied by a user.

BRIEF DESCRIPTION

In one aspect, a lid assembly for a leak resistant drinking cup generally comprises a closure member including a socket in fluid communication with a liquid passageway. The socket has a wall with a cutout therein. A valve assembly includes a plug adapted for insertion into the socket of the closure member to form a seal between the socket and the plug. The plug has a base, a side wall, and an interior chamber cooperatively defined by the base and the side wall. The seal formed between the plug and socket is selectively moveable from a sealed configuration wherein the plug inhibits fluid communication between the cutout in the socket and the liquid passageway to an unsealed configuration by vacuum pressure being applied to the interior chamber of the plug above a threshold value. Application of vacuum pressure above the threshold value causes a portion of the side wall of the plug to flex away from the socket thereby opening fluid communication between the cutout in the socket and the liquid passageway.

In another aspect, a lid assembly for a leak resistant drinking cup generally comprises a closure member including a first elliptical socket having a wall with a cutout therein and a second elliptical socket having a wall with a cutout therein. The second elliptical socket is spaced from the first elliptical socket. A vent aperture is in fluid communication with the first elliptical socket, and a liquid passageway is in fluid communication with the second elliptical socket. A valve assembly comprises a first tubular plug adapted to couple to and form a seal with the first elliptical socket of the closure member. The first tubular plug includes a base and a side wall extending up from the base. The base and the side wall cooperatively define an interior chamber of the first tubular plug. The seal formed between the first tubular plug and the first elliptical socket is moveable between a sealed configuration and an unsealed configuration by movement of a portion of the side wall of the first tubular plug away from the cutout in the first elliptical socket. A second tubular plug of the valve assembly is adapted to couple to and form a seal with the second elliptical socket of the closure member. The second tubular plug includes a base and a side wall extending up from the base. The base and the side wall cooperatively define an interior chamber of the second tubular plug. The seal formed between the second tubular plug and the second elliptical socket is moveable between a sealed configuration and an unsealed configuration by movement of a portion of the side wall of the second tubular plug away from the cutout in the second elliptical socket.

In yet a further aspect, a leak resistant drinking cup generally comprises a container adapted to hold liquid and a lid assembly selectively attachable to and detachable from the container. The lid assembly comprises a closure member including a socket in fluid communication with a liquid passageway. A valve assembly includes a plug adapted for insertion into the socket of the closure member to form a vertical seal between the socket and the plug. The plug has a base, a side wall, and an interior chamber cooperatively defined by the base and the side wall. The seal formed between the plug and socket is selectively moveable from a sealed configuration wherein the plug inhibits fluid communication with the liquid passageway to an unsealed configuration by vacuum pressure being applied to the interior chamber of the plug above a threshold value. Application of vacuum pressure above the threshold value causes the portion of the side wall of the plug to flex away from the socket thereby opening fluid communication with the liquid passageway.

In still yet another aspect, a valve assembly for a leak resistant drinking cup is free of slits or cuts.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
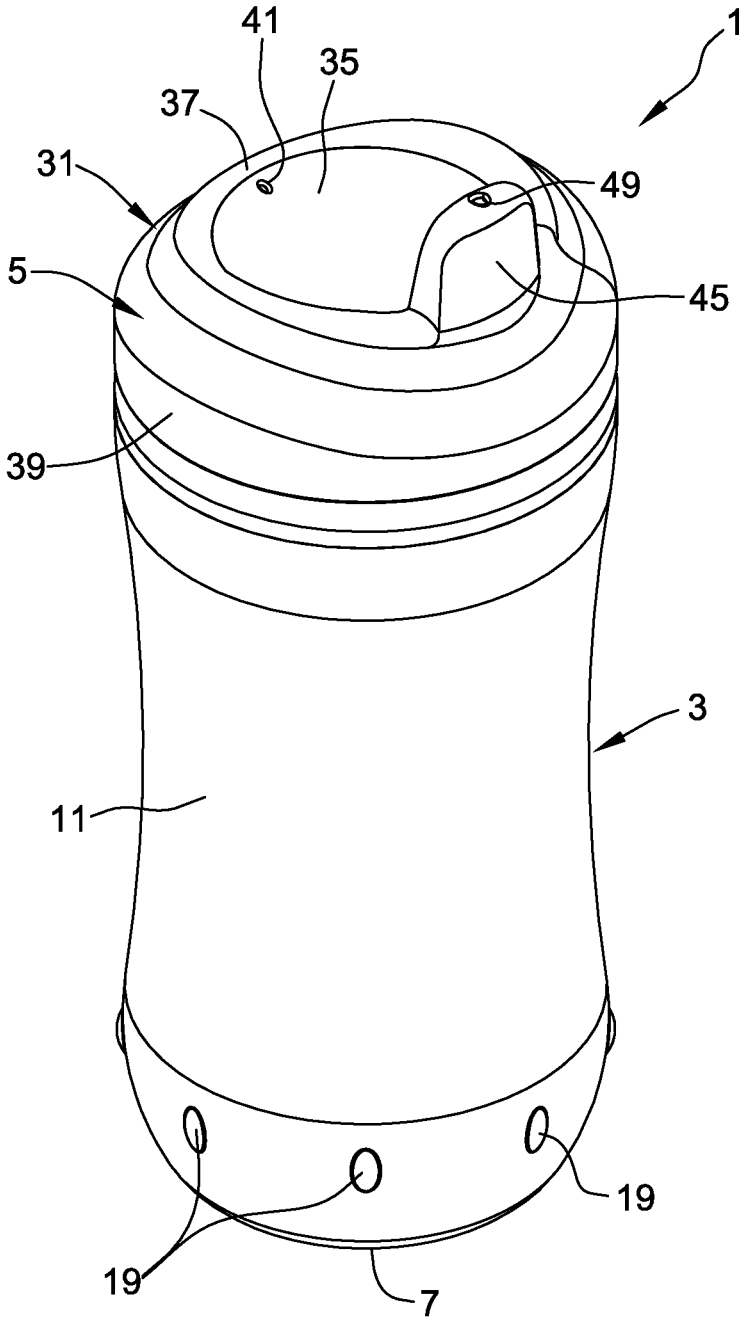
FIG. 1 is a perspective of one embodiment of a leak resistant drinking cup having a container and a lid assembly coupled to the container.
Figure 2:
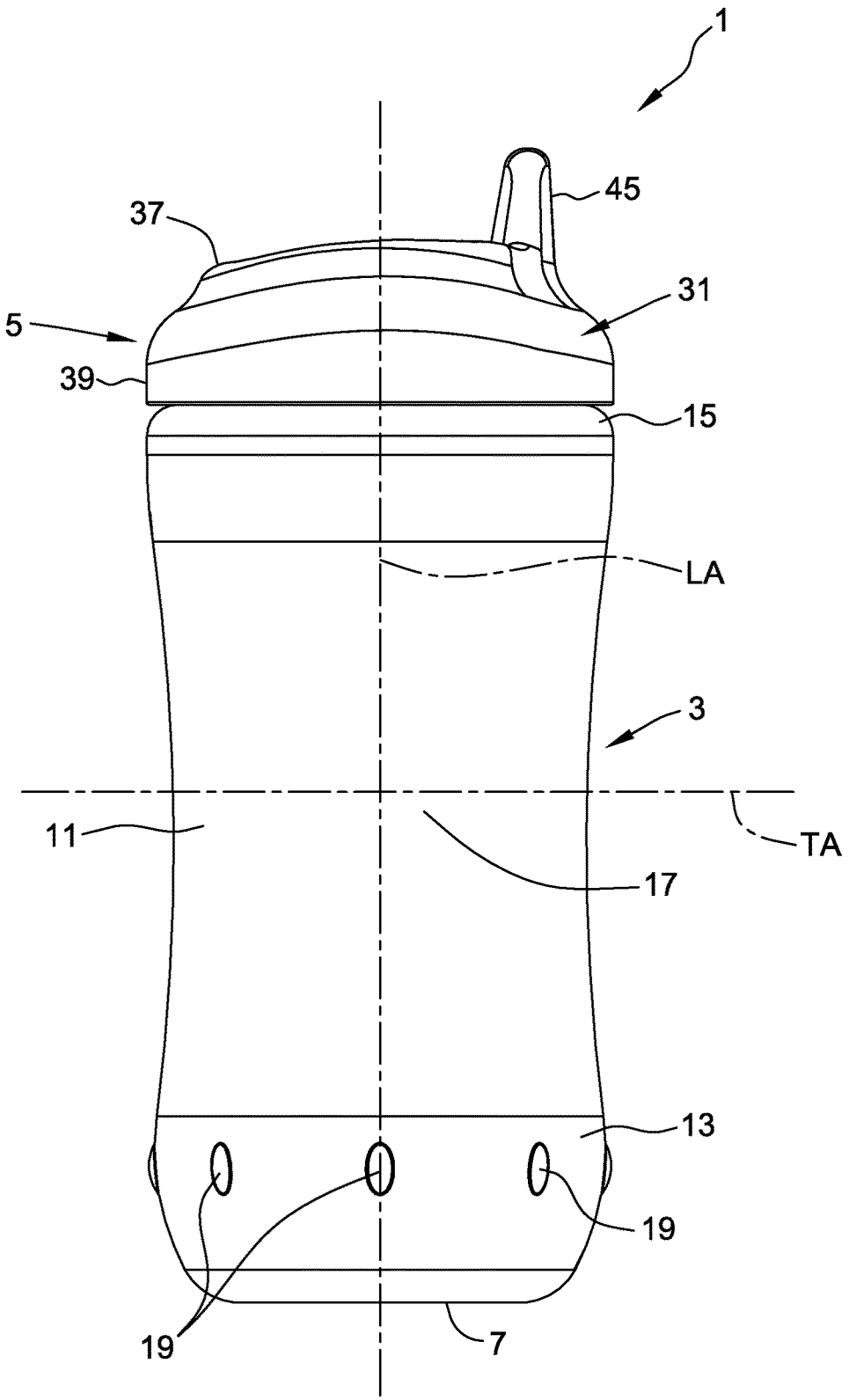
FIG. 2 is a side elevation of the cup.
Figure 3:
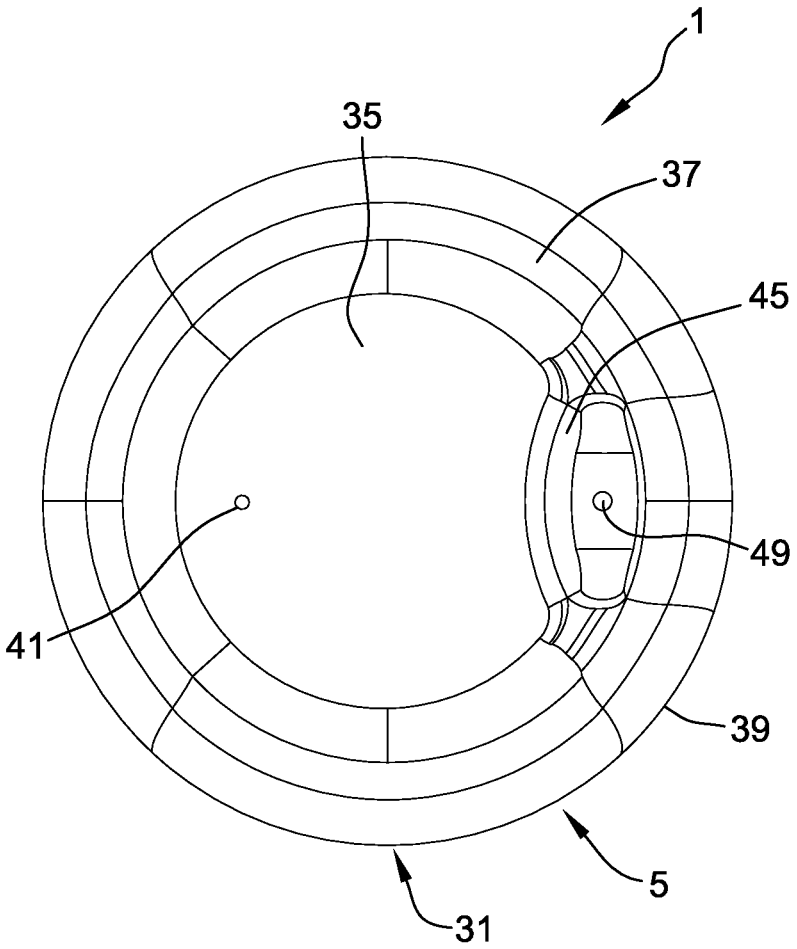
FIG. 3 is a top view of the cup.
Figure 4:
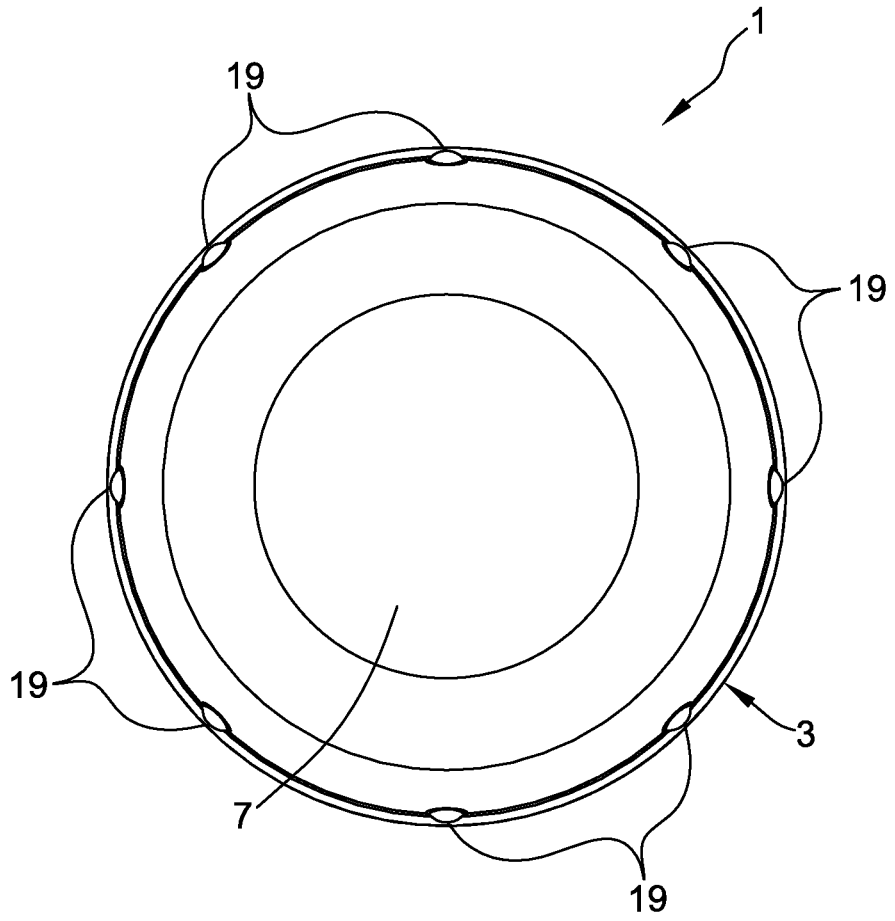
FIG. 4 is a bottom view of the cup.
Figure 5:
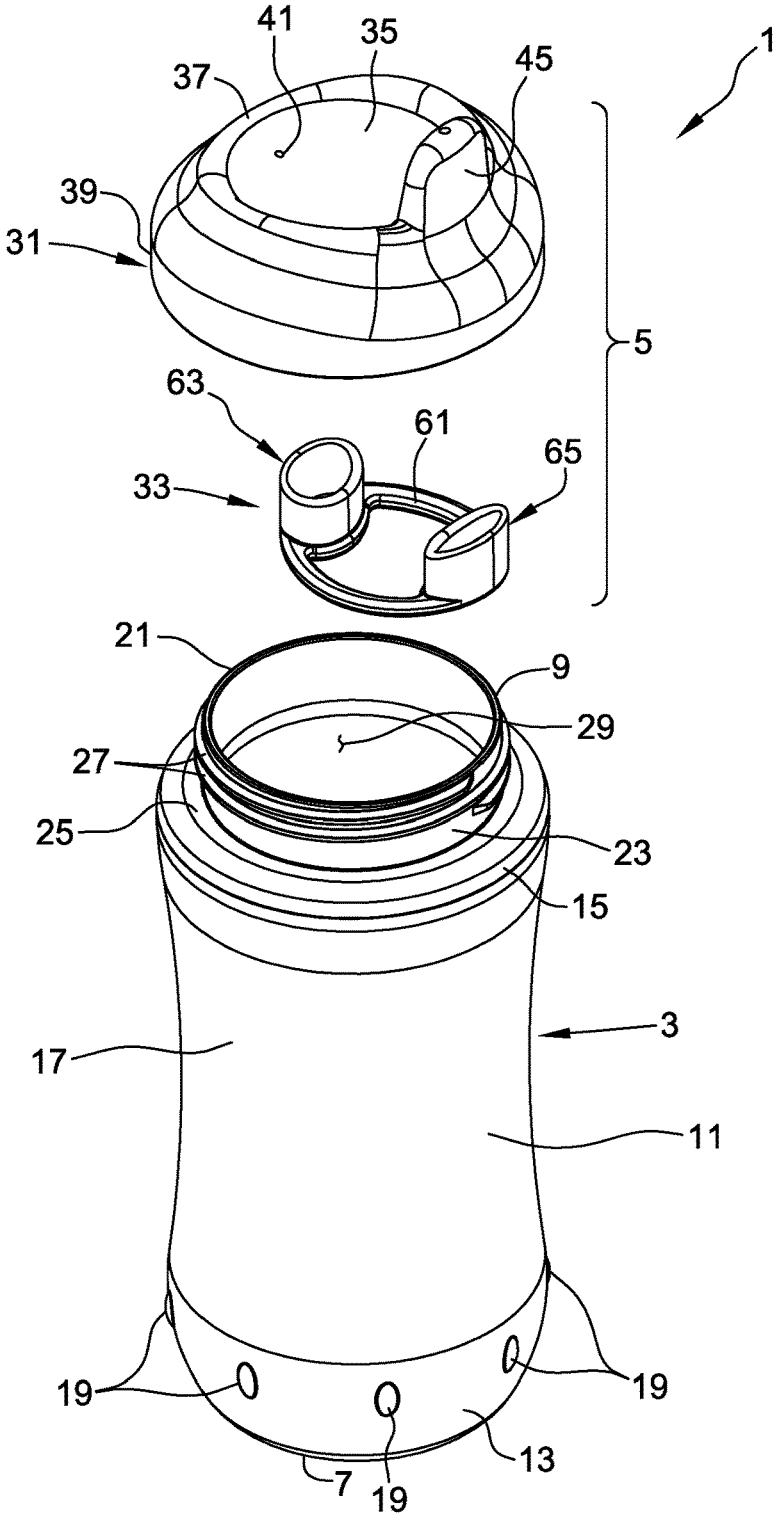
FIG. 5 is an exploded perspective of the cup.
Figure 6:
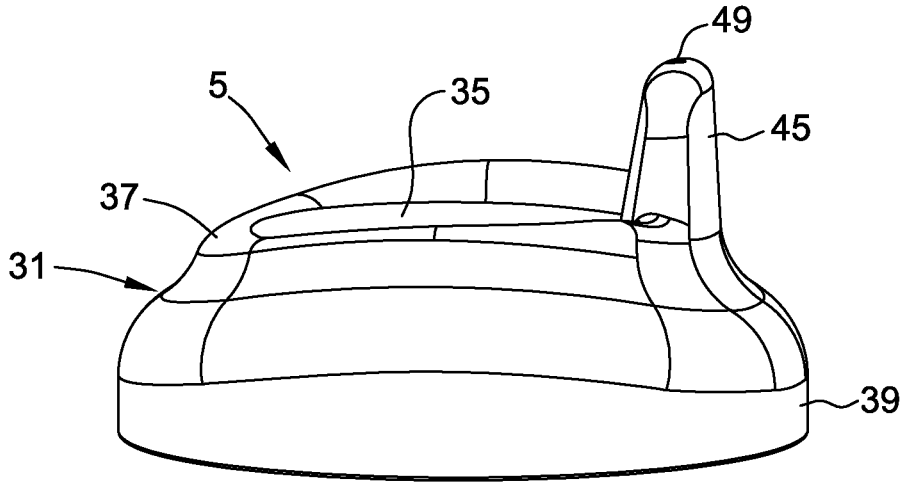
FIG. 6 is a side elevation of the lid assembly removed from the container, the lid assembly including a closure member and a valve assembly secured to the closure member.

Referring now to the drawings and in particular to FIGS. 1-5, a leak resistant drinking cup, generally indicated at 1, includes a container, which is generally indicated at 3, and a lid assembly, which is generally indicated at 5. The illustrated container 3 is generally cylindrical and symmetric about a central or longitudinal axis LA of the cup 1. The longitudinal axis LA and a transverse axis TA of the cup 1 are identified in FIG. 2. As seen in FIGS. 4 and 5, the container 3 has a closed bottom 7, an open top 9, and a generally cylindrical side wall 11 extending between the closed bottom and the open top. The cylindrical side wall 11 includes a base portion 13, a top portion 15, and a concaved middle portion 17 extending between the base and top portions (FIG. 5). The middle portion 17 of the side wall 11 of the illustrated container 3 is concaved to facilitate grasping of the container and thereby the cup 1. It is understood, however, that the middle portion 17 can be convex or generally straight. The base portion 13 of the side wall 11 has a plurality of circumferentially spaced-apart nubs 19. As illustrated in FIG. 5, the top portion 15 of the side wall 11 includes a circular upper edge 21, an attachment collar 23 disposed beneath and adjacent to the upper edge, and a shoulder 25 disposed below the attachment collar. The attachment collar 23, as seen in FIG. 5, has external threads 27 thereon.

The illustrated container 3 has a liquid chamber 29 adapted to hold a quantity of liquid for consumption by a user, such as a small child. More specifically, the illustrated container 3 is adapted to hold approximately 10 ounces of liquid. It is to be understood, however, that the cup 1 can be sized to hold other quantities of liquid (e.g., 6 ounces, 9 ounces, 12 ounces, 20 ounces, etc.). For example, the container 3 can be adapted for older children or adults and hold larger quantities of liquid. It is also understood that the container 3 can have a different configuration than the one illustrated herein, such as a sports bottle, a drink tumbler, a commuter cup, etc.

The container 3 can be made of any suitable material such as, without limitation, polypropylene, aluminum, or stainless steel. The container 3 can also be made in any desired color or colors, and may be transparent, translucent, opaque, or combinations thereof. The container 3 can be rigid, as illustrated in FIGS. 1-5, or non-rigid. It is further understood that the container 3 can be insulated or non-insulated. The container 3 illustrated in FIGS. 1-5, for example, is insulated having an inner container wall 11*a* and an outer container wall 11*b* that is spaced from the inner container wall (see, e.g., FIGS. 14 and 15). In other words, the container 3 is double walled for insulation purposes as is known in the art. It is contemplated that the container 3 can comprise a single, non-insulated wall.

Figure 7:
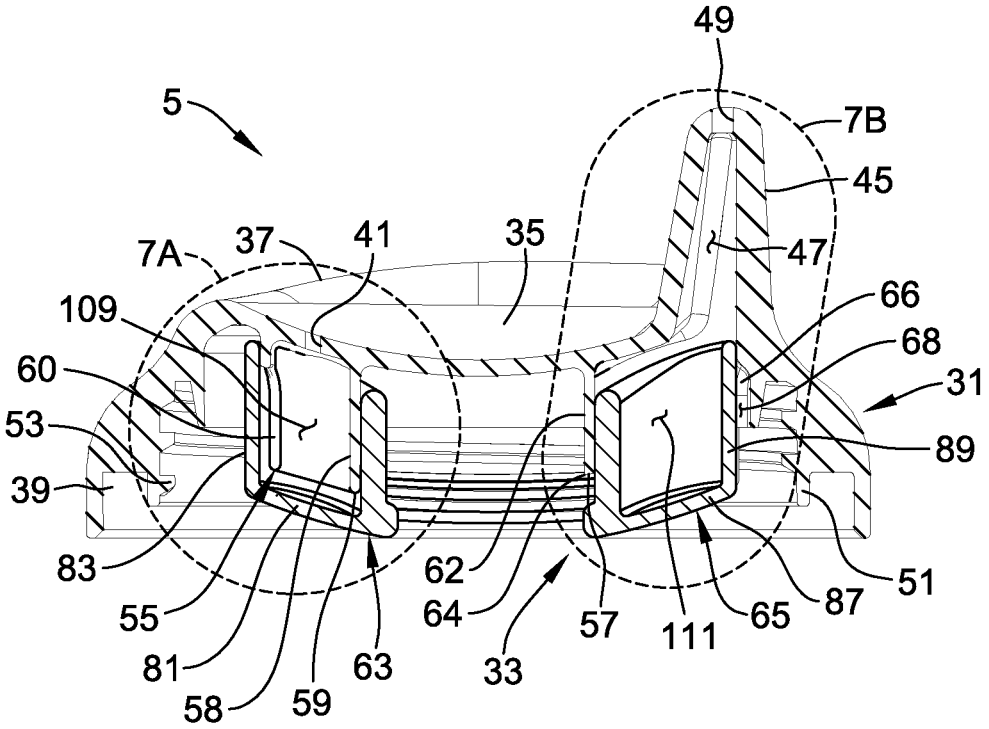
FIG. 7 is a vertical cross-section of the lid assembly illustrated in FIG. 6 illustrating the valve assembly secured to the closure member, the valve assembly being in a closed, sealed configuration.

The lid assembly 5 of the cup 1 is adapted for removable attachment to the container 3 for selectively closing the open top 9 of the container. The lid assembly 5, as illustrated in FIGS. 5 and 7, comprises a closure member 31 and a valve assembly 33 (each of the lid assembly components being indicated generally by their respective reference numbers). As described in more detail below, the valve assembly 33 is operable to block the flow of liquid from the liquid chamber 29 of the container 3 to thereby inhibit liquid being spilled from the cup 1. As also described in more detail below, the valve assembly 33 can be deflected, flexed, or otherwise reconfigured by application of vacuum pressure applied by a user drinking from the cup 1 to permit liquid in the container 3 to flow past the valve assembly and out of the cup. In addition and as described in more detail below, the valve assembly 33 is further operable to block the flow of air into the liquid chamber 29 of the container 3 but can be deflected, flexed, or otherwise reconfigured by application of vacuum pressure applied by a user drinking from the cup 1 to permit air to flow past the valve assembly and into the container. Thus, the valve assembly 33 disclosed herein regulates both the flow of liquid from the container 3 and the flow of air into the container.

The closure member 31 and the valve assembly 33 can be made of any suitable materials. In one suitable embodiment, for example, the closure member 31 can be made of polypropylene and the valve assembly 33 can be made of silicone. The closure member 31 and the valve assembly 33 can be made in any desired color or colors, and may be transparent, translucent, opaque, or combinations thereof.

The cup 1 can optionally include a cap (not shown) that is removeably securable to the closure member 31 via a snap-fit (or any suitable) connection. The cap can be selectively placed on the closure member 31 during periods of non-use (e.g., storage, travel) of the cup 1 and removed during periods of use. The cap can be made of any suitable material, such as polypropylene, and can be made in any desired color or colors, and may be transparent, translucent, or opaque. One suitable cap for use with the cup 1 described herein is disclosed in U.S. Pat. No. 8,333,299 to Bernard J. Kemper et al., which is incorporated herein in its entirety.

The illustrated cup 1 can also optionally include a handle assembly (not shown) for grasping by the user of the cup. One suitable handle assembly for use with the cup 1 described herein is disclosed in U.S. Pat. No. 8,333,299 to Bernard J. Kemper et al., which is incorporated herein in its entirety.

With reference now to FIGS. 1-3 and 5-7, the closure member 31 of the lid assembly 5 includes a concaved, central upper portion 35, an annular ridge 37 circumscribing and extending upward from the central upper portion, and a peripheral skirt 39 depending downward from the annular ridge. The upper portion 35 includes a relatively small, circular vent aperture 41 disposed adjacent the annular ridge 37. The vent aperture 41 allows air to pass through the closure member 31 and into the container 3 when the closure member is attached to the container. The closure member 31 further comprises a spout 45 (broadly, a "liquid discharge member") projecting up from the annular ridge 37. The spout 45 includes a passageway 47 (FIG. 7) and an opening 49 fluidly connected to the passageway for allowing vacuum pressure (or suction) to be applied to the valve assembly 33 and liquid to exit (or discharge) the drinking cup 1. It is understood that the liquid discharge member can be other than a spout, e.g., an elliptical opening or a straw, without departing from the scope of this disclosure. It is also understood that, in other suitable embodiments, the spout 45 (or liquid discharge member) can be formed separately from the closure member 31.

Figure 8:
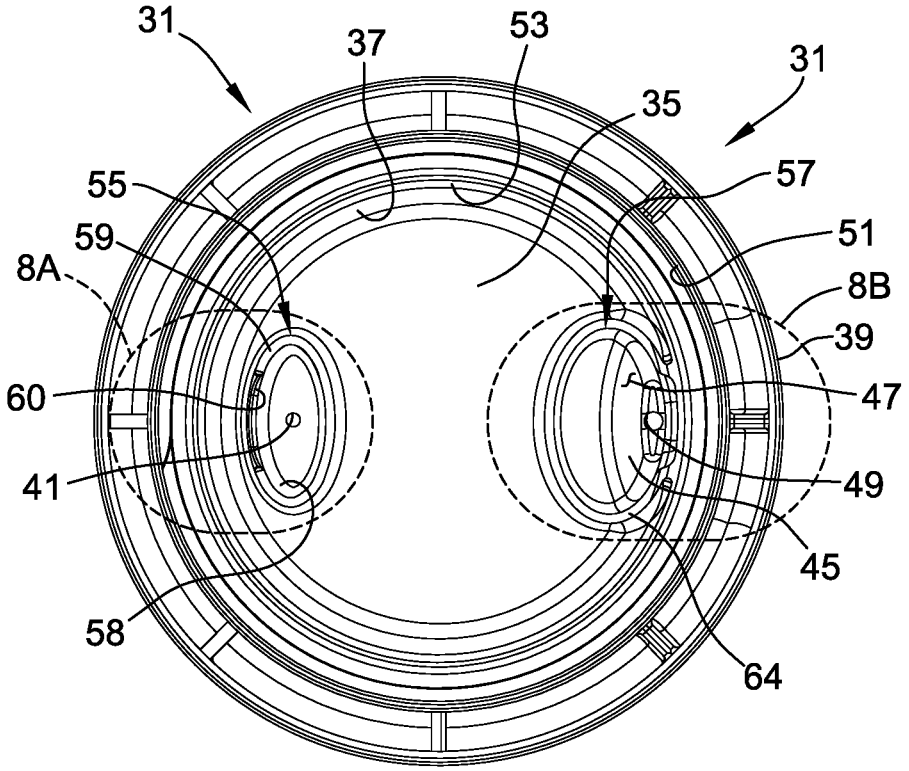
FIG. 8 is a bottom view of the closure member having the valve assembly removed therefrom.

As illustrated in FIGS. 7 and 8, the closure member 31 has an inner socket 51 disposed inboard of the peripheral skirt 39. The inner socket 51 includes internal threads 53 for releasably mating with the external threads 27 of the attachment collar 23 of the container 3. Thus, the closure member 31 can be selectively attached and detached from the container 3 via the threaded connection between the internal threads 53 of the inner socket 51 and the external threads 27 of the attachment collar 23. It is understood, however, that the closure member 31 can be selectively attached and detached from the container 3 using any suitable connection (e.g., snap-fit).

Figure 8A:
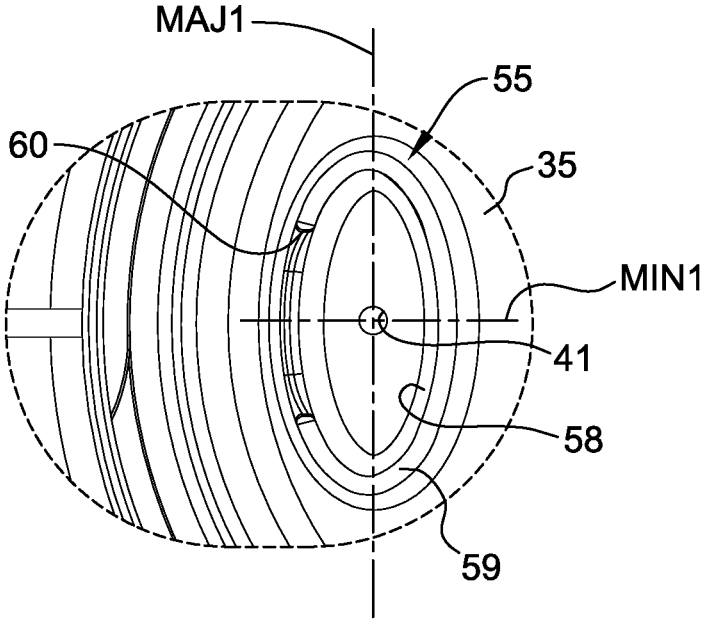
FIG. 8A is an enlarged fragmentary view of the cross-section illustrated in FIG. 8 taken from area "8A" of FIG. 8.
Figure 8B:
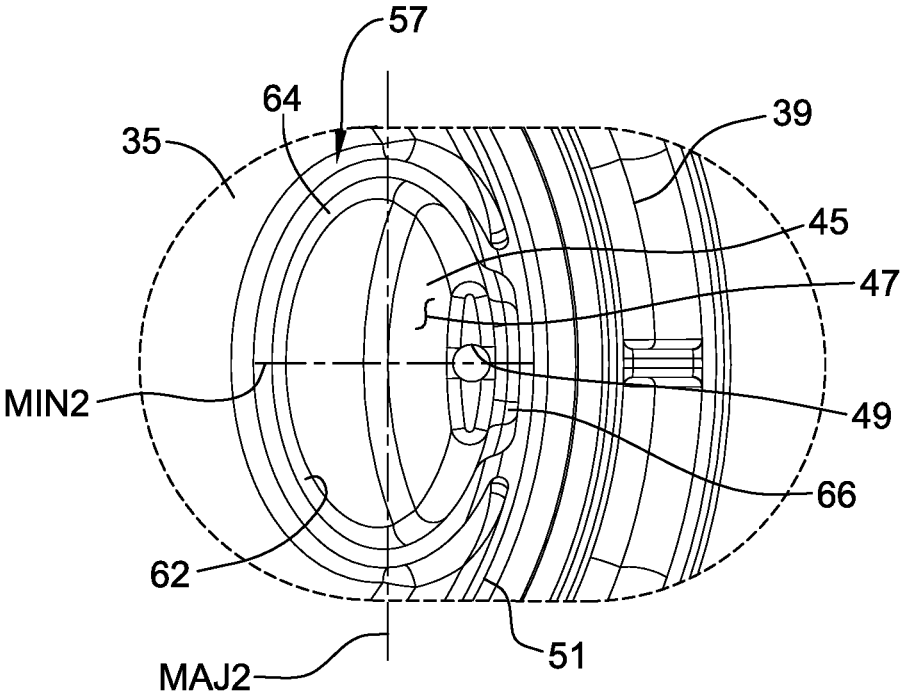
FIG. 8B is an enlarged fragmentary view of the cross-section illustrated in FIG. 8 taken from area "8B" of FIG. 8.

The closure member 31, as illustrated in FIGS. 7 and 8, also includes a first interior, elliptical socket 55 extending downward from the central upper portion 35 and circumscribing the vent aperture 41. As best seen in FIGS. 8 and 8A, the vent aperture 41 in the upper portion 35 is generally centered relative to the first elliptical socket 55. A second elliptical socket 57 is spaced from and opposed the first elliptical socket 55. As best seen in FIGS. 8 and 8B, the second elliptical socket 57 is fluidly connected with the passageway 47 of the spout 45. In the illustrated embodiment, the passageway 47 of the spout 45 is aligned with approximately half of the second elliptical socket 57. It is understood, however, that the passageway 47 of the spout 45 can be aligned with more or less of the second elliptical socket 57 including its entirety.

As seen in FIG. 8A, the first elliptical socket 55 includes a major axis MAJ1, a minor axis MIN1, and a wall 58 extending downward from the upper portion 35 of the closure member 31. The wall 58 defines a perimeter of the socket, a height, and an outer, free edge 59 of the first elliptical socket 55. In the illustrated embodiment, the first elliptical socket 55 is generally elliptical in shape. However, it is contemplated that the first elliptical socket 55 can have any suitable shape including, but not limited to, circular, ovate, rectangular.

The wall 58 includes a generally U-shaped cutout 60 that extends, in the illustrated embodiment, from the outer edge 59 to approximate the upper portion 35. In the embodiment seen in FIG. 7A, the cutout 60 does not extend through the entire height of the wall 58. In other words, in the illustrated embodiment, the cutout 60 has a height that is less than the height of the wall 58. Suitably, the cutout 60 extends between approximately 25 percent and 99 percent the height of the wall 58. More suitably, the cutout 60 extends between approximately 50 percent and 90 percent the height of the wall 58. For example, in the illustrated embodiment, the cutout 60 extends approximately 75 percent the height of the wall 58.

Moreover, in the illustrated embodiment, the cutout 60 extends less than 50 percent of the perimeter of the wall 58. Suitably, the cutout 60 extends between about 5 percent and about 45 percent the perimeter of the wall 58. More suitably, the cutout 60 extends between about 15 percent and about 35 percent the perimeter of the wall. In one preferred embodiment and as seen in the illustrated embodiment, the cutout 60 extends approximately 22 percent the perimeter of the wall 58. In one suitable embodiment, the cutout 60 has a width (as measured along the perimeter of the wall 58) between about 1 mm and about 20.7 mm and, more suitably, between about 5 mm and about 15 mm. In the illustrated embodiment, for example, the cutout has a width of approximately 10 mm. It is contemplated that the cutout 60 in the wall 58 can have any suitable size and shape without departing from some aspects of this disclosure. That is, the cutout 60 can be other than generally U-shaped without departing from some aspects of this disclosure.

In the illustrated embodiment, the cutout 60 in the wall 58 of the first elliptical socket 55 is disposed adjacent to but spaced from the inner socket 51. In addition, the cutout 60 is generally aligned with the minor axis MIN1 of the first elliptical socket 55 such that approximately half of the cutout 60 is disposed on one side of the minor axis and the other half of the cutout is disposed on the opposite side of the minor axis. It is understood, however, that the cutout 60 can have different locations relative to the inner socket 51 and the minor axis MIN1. That is, the cutout 60 can be disposed along any suitable portion of the wall 58.

In one suitable embodiment, the width of the first elliptical socket 55 as measured along the major axis MAJ1 is between about 6 and 133 mm and, more preferably, between about 10 mm and 50 mm. In one preferred embodiment, the first elliptical socket 55 as measured along the major axis MAJ1 is 18 mm. Suitably, the width of the first elliptical socket as measured along the minor axis MIN1 is between about 3 mm and 107 mm and, more preferably, between about 5 and 40 mm. In one preferred embodiment, the width of the first elliptical socket as measured along the minor axis MIN1 is 9 mm. In one embodiment, a ratio of the width of the first elliptical socket 55 as measured along the major axis MAJ1 to the width of the first elliptical socket as measured along the minor axis MIN1 is less than about 10, and, more suitably, less than about 5. In the illustrated embodiment for example, the ratio of the width of the first elliptical socket 55 as measured along the major axis MAJ1 to the width of the first elliptical socket as measured along the minor axis MIN1 is 2.

With reference now to FIG. 8B, the second elliptical socket 57 includes a major axis MAJ2, a minor axis MIN2, and a wall 62 extending downward from the upper portion 35 of the closure member 31. The wall 62 defines a perimeter, a height, and an outer, free edge 64 of the second elliptical socket 57. In the illustrated embodiment, the second elliptical socket 57 is generally elliptical in shape. However, it is contemplated that the second elliptical socket 57 can have any suitable shape including, but not limited to, circular, ovate, rectangular. It is further contemplated that is some suitable embodiments the second elliptical socket 57 can have a generally shape that differs from the generally shape of the first elliptical socket 55.

The wall includes a generally U-shaped cutout 66 that extends, in the illustrated embodiment, from the edge towards, but spaced from, the upper portion. In the embodiment seen in FIGS. 8 and 8A, the cutout 66 does not extend through the entire height in the wall 62. In other words, in the illustrated embodiment, the cutout 66 has a height that is less than the height of the wall 62. Suitably, the cutout 66 extends between approximately 25 percent and 99 percent the height of the wall 62. More suitably, the cutout 66 extends between approximately 50 percent and 80 percent the height of the wall 62. For example, in the illustrated embodiment, the cutout 66 extends approximately 75 percent the height of the wall 62. Preferably, the height of the cutout is selected to provide a suitable seal and facilitate drinkability.

Moreover, in the illustrated embodiment, the cutout 66 extends less than 50 percent of the perimeter of the wall 62. Suitably, the cutout 66 extends between about 5 percent and about 45 percent the perimeter of the wall 62. More suitably, the cutout 66 extends between about 15 percent and about 35 percent the perimeter of the wall 62. In one preferred embodiment and as seen in the illustrated embodiment, the cutout 66 extends approximately 22 percent the perimeter of the wall 62. In one suitable embodiment, the cutout 66 has a width (as measured along the perimeter of the wall 62) between about 1 mm and about 22.9 mm and, more suitably, between about 5 mm and about 17 mm. In the illustrated embodiment, for example, the cutout has a width of approximately 12 mm. It is contemplated that the cutout 66 in the wall 62 can have any suitable size and shape without departing from some aspects of this disclosure. That is, the cutout 66 can be other than generally U-shaped without departing from some aspects of this disclosure.

In the illustrated embodiment, the second elliptical socket 57 intersects the inner socket 51 such that the wall of the second elliptical socket and the inner socket 51 are connected. More specifically and as seen in FIGS. 8 and 8B, the inner socket 51 closes the cutout 66 in the second elliptical socket 57. Thus, the wall 62 of the second elliptical socket 57 and the inner socket 51 cooperatively define a recess 68 (FIG. 7B). In addition, the cutout 66 is generally aligned with the minor axis MIN2 of the second elliptical socket 57 such that approximately half of the cutout is disposed on one side of the minor axis and the other half of the cutout is disposed on the opposite side of the minor axis. It is understood, however, that the cutout 66 can have different locations relative to the inner socket 51 and the minor axis MIN2. That is, the cutout 66 can be disposed along any suitable portion of the wall 62.

In one suitable embodiment, the width of the second elliptical socket 57 as measured along the major axis MAJ2 is between about 6 mm and 133 mm and, more preferably, between about 10 mm and 50 mm. In one preferred embodiment, the second elliptical socket 57 as measured along the major axis MAJ2 is 22 mm. Suitably, the width of the second elliptical socket 57 as measured along the minor axis MIN2 is between about 3 mm and 107 mm and, more preferably, between about 5 mm and 40 mm. In one preferred embodiment, the width of the second elliptical socket 57 as measured along the minor axis MIN2 is 14 mm. In one embodiment, a ratio of the width of the second elliptical socket 57 as measured along the major axis MAJ2 to the width of the second elliptical socket as measured along the minor axis MIN2 is less than about 10, and, more suitably, less than about 5. In the illustrated embodiment for example, the ratio of the width of the second elliptical socket 57 as measured along the major axis MAJ2 to the width of the second elliptical socket as measured along the minor axis MIN2 is 1.6.

The first elliptical socket 55 and the second elliptical socket 57 are sized and shaped to facilitate attachment of the valve assembly 33 to the closure member 31 in two different orientations as described in more detail below. It is noted that in the illustrated embodiment the first elliptical socket 55 and the second elliptical socket 57 have generally the same shape. That is, both the first and second elliptical sockets 55, 57 are elliptical. However, the first elliptical socket 55 is smaller in size than the second elliptical socket 57. It is understood that the sockets 55, 57 can have any suitable size or shape. It is also understood that the sockets 55, 57 can have different sizes and shapes relative to each other without departing from some aspects of this disclosure.

As illustrated in FIGS. 9-13, the valve assembly 33 includes a generally ovate or racetrack-shaped base 61, a first elliptical tubular plug, indicated generally at 63 and a second elliptical tubular plug, indicated generally at 65. The first elliptical tubular plug 63 is adapted to couple to one of the first or second elliptical sockets 55, 57 of the closure member 31, and the second elliptical tubular plug 65 is adapted to couple to the other elliptical socket 55, 57 of the closure member. In the illustrated embodiment, the valve assembly 33 can be attached to the closure member 31 is two different orientations. In one orientation, the first elliptical tubular plug can be coupled to the first elliptical socket 55 of the closure member 31, and the second elliptical tubular plug 65 can be couple to second elliptical socket 57 of the closure member (see, e.g., FIG. 7). In the other configuration, the first elliptical tubular plug can be coupled to the second elliptical socket 57 of the closure member 31, and the second elliptical tubular plug 65 can be couple to first elliptical socket 55 of the closure member. It is understood, however, that the valve assembly 33 can be configured to be coupled to the closure member 31 in a single orientation.

Figure 9:
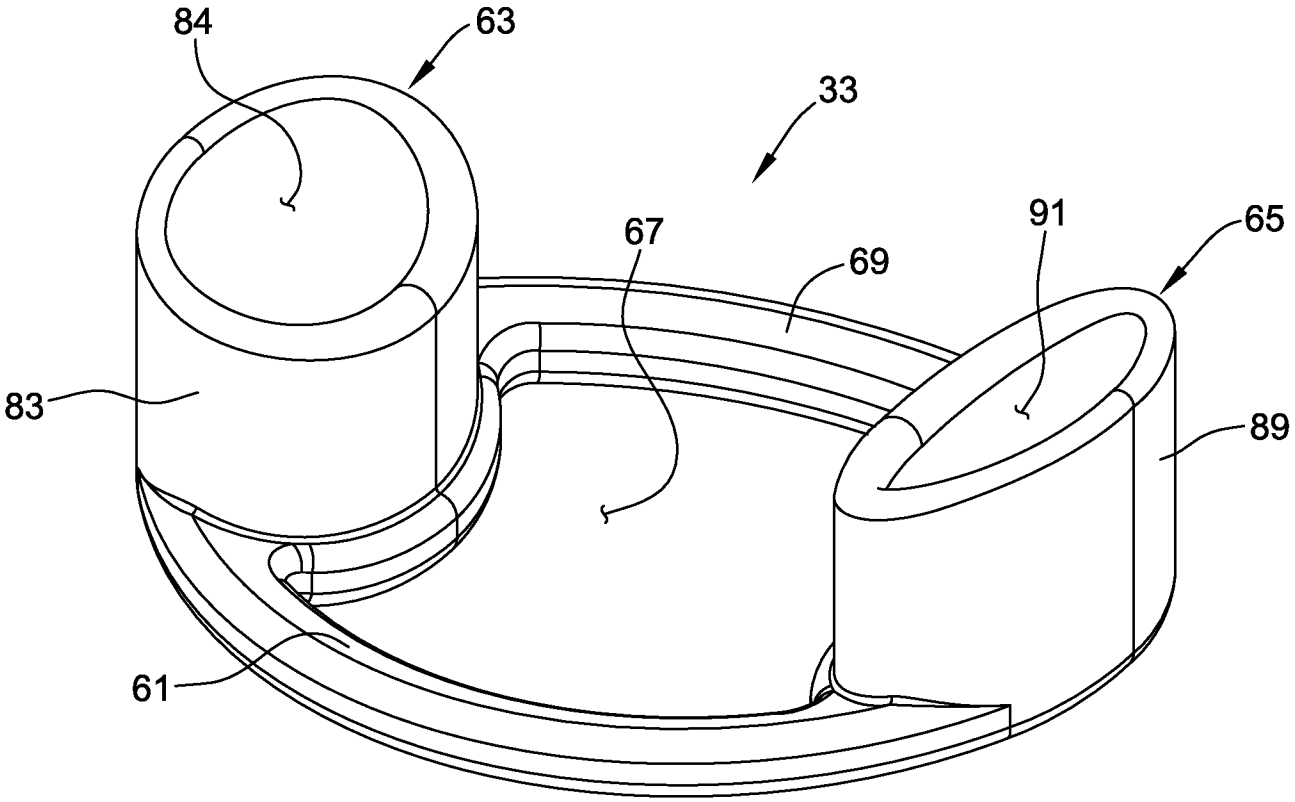
FIG. 9 is a perspective of the valve assembly of the lid assembly removed from the closure member.
Figure 10:
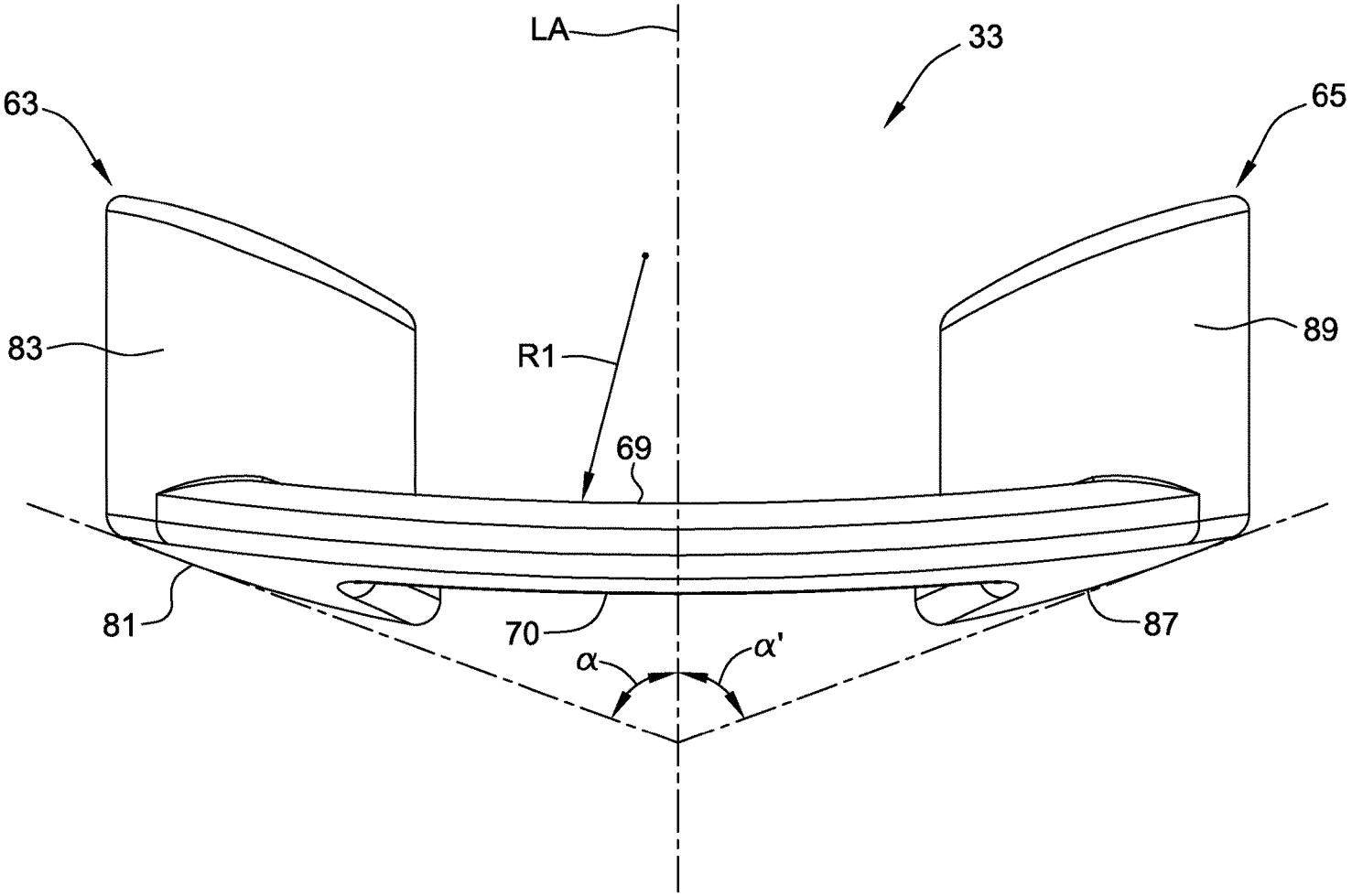
FIG. 10 is a side elevation of the valve assembly.
Figure 11:
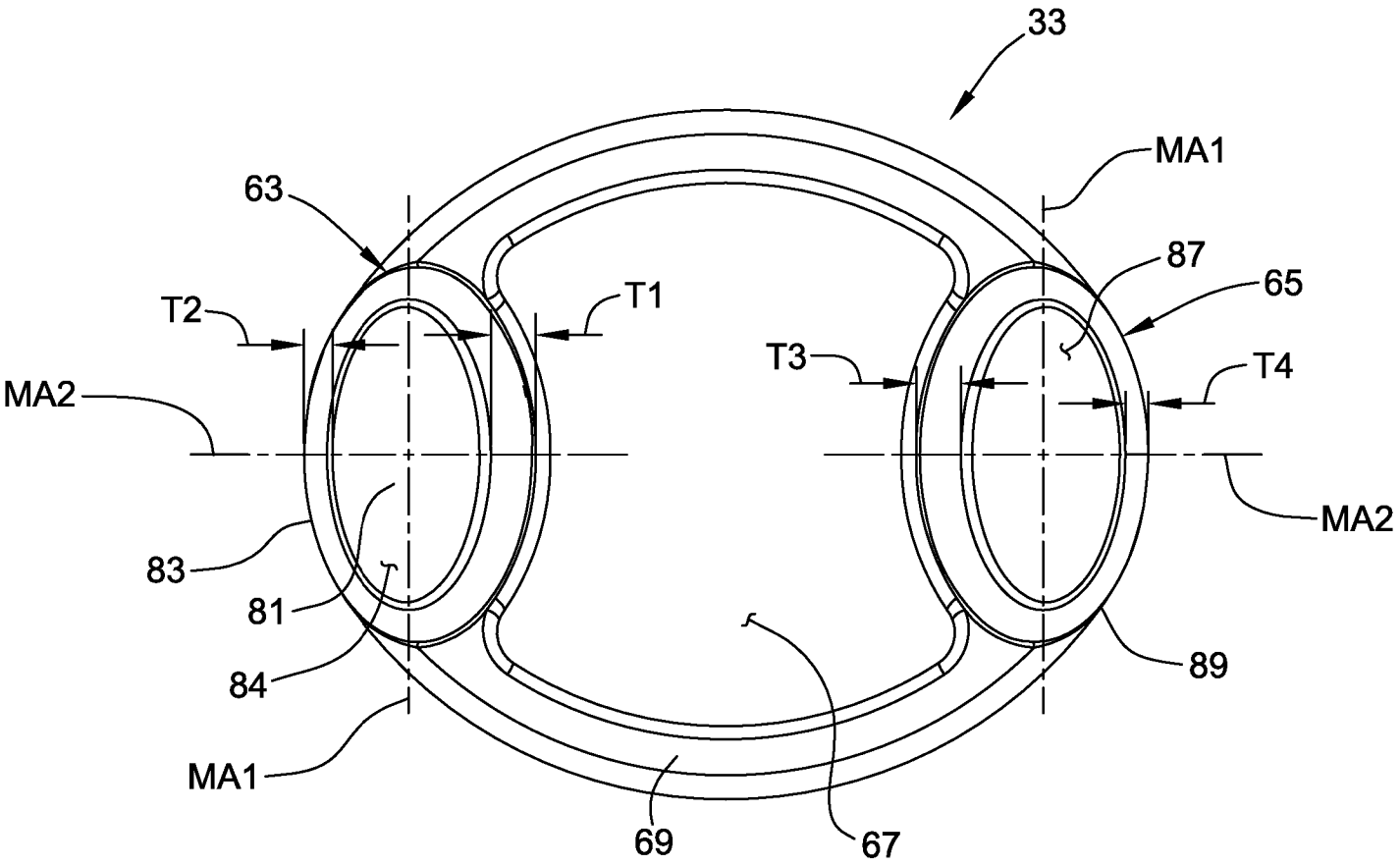
FIG. 11 is a top view of the valve assembly.
Figure 12:
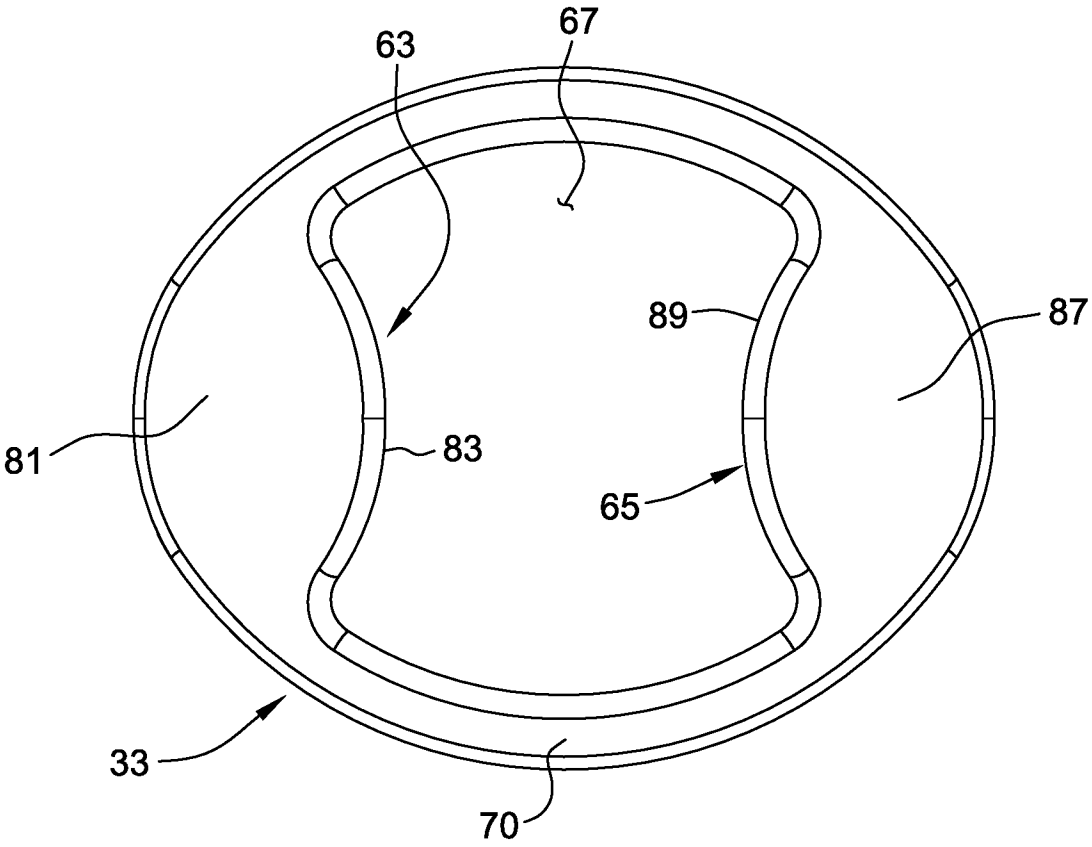
FIG. 12 is a bottom view of the valve assembly.
Figure 13:
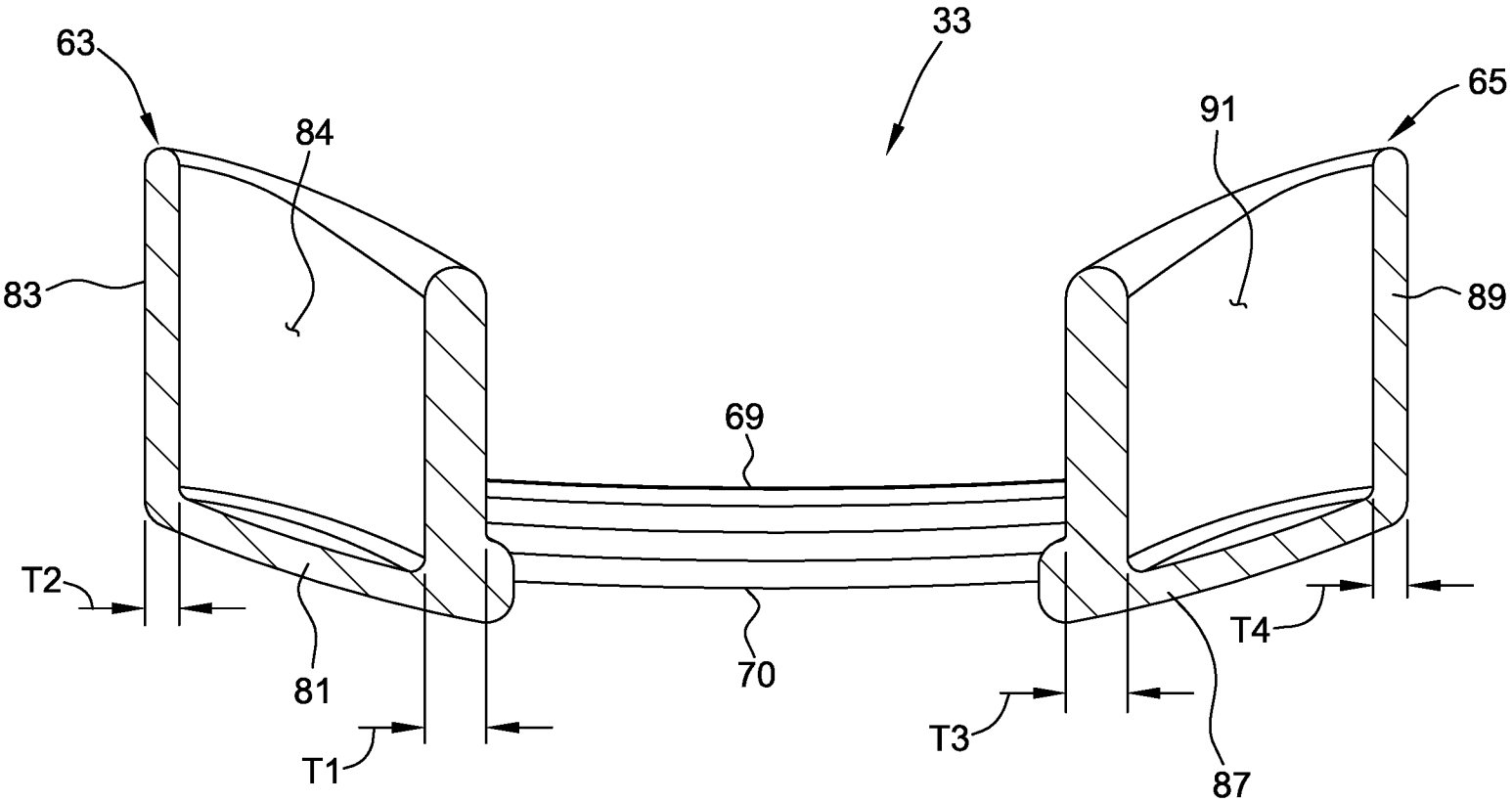
FIG. 13 is a vertical cross-section taken from the side elevation of FIG. 10.

As best seen in FIGS. 9, 11 and 12, the ovate platform 61 includes a relatively large central opening 67, an upper surface 69 (FIG. 11), and a lower surface 70 (FIG. 12). In the illustrated embodiment and as best seen in FIGS. 10 and 13, the platform 61 is slightly arcuate and, as a result, the upper and lower surfaces 69, 70 are non-planar. In one suitable embodiment, the arcuate platform 61 has a radius R1 between about 150 mm and about 200 mm. For example, in the illustrated embodiment, the platform 61 has a radius of about 167 mm. It is understood, however, that the platform 61 can be flat such that the upper and lower surfaces 69, 70 are generally planar without departing from some aspects of this disclosure. It is also understood that the platform 61 can a radius different than those disclosed herein without departing from some aspects of this disclosure. It is further understood that in some suitable embodiments, the opening 67 can be omitted. In such an embodiment, the platform 61 can be, for example, generally solid disk. It is understood that the platform 61 can have any suitable shape.

With reference now to FIGS. 10, 11 and 13, the first elliptical tubular plug 63 of the valve assembly 33 includes a base (or bottom) 81 and a side wall 83 extending up from the base. The base 81 and the side wall 83 cooperatively define an interior chamber 84 of the plug 63. As seen in FIGS. 10 and 13, the base 81 (and thus the side wall 83 extending therefrom) is angled relative to the longitudinal axis LA of the cup 1 such that the base slopes downward toward the central opening 67. In the illustrated embodiment, for example, the base 81 and thus the side wall 83 extending therefrom, which has a generally constant height, define an angle $\alpha$ relative to the longitudinal axis LA of the cup 1 between about 60 degrees and about 80 degrees (FIG. 10). In the illustrated embodiment, for example, the base 81 and the side wall 83 define an angle $\alpha$ about 70 degrees relative to the longitudinal axis LA. It is understood that the base 81 and the wall 83 can be arranged in any suitable configuration. For example, in one suitable embodiment, the angle $\alpha$ between the longitudinal axis LA and the base 81 (and the side wall 83) can be 90 degrees so that the base is disposed in a planar orientation. In such an embodiment, the side wall 83 would not necessarily be canted. Rather, the side wall 83 can be oriented relative to the transverse axis TA of the cup 1.

With reference now to FIG. 11, the first elliptical tubular plug 63 has a major axis MA1 and a minor axis MA2. As a result, the maximum extent of the first elliptical tubular plug 63 along the major axis MA1 is greater than the maximum extent of the first elliptical tubular plug along the minor axis A2. For example, in one suitable embodiment, the major axis MA1 can be between 6 mm and 133 mm, more preferably between 16 mm and 66 mm, and even more preferably between 20 mm and 26 mm, and the minor axis MA2 can be between 4 mm and 107 mm, more preferably between 8 mm and 53 mm, and even more preferably between 10 mm and 21 mm. Suitably, the ratio of the maximum extents between the major axis MA1 and the minor axis MA2 is between 1 and 10, more preferably between 1.2 and 5, and even more preferably between 1.5 and 2. Suitably, the ratio between the maximum extents of the major axis MA1 and the minor axis MA2 is greater than 1 and less than 10.

With reference now to FIGS. 11 and 13, the side wall 83 of the first elliptical tubular plug 63 varies in thickness. In other words, the thickness of the side wall 83 is not uniform but instead tapers from a maximum thickness T1 to a minimum thickness T2. As seen in FIG. 11, the maximum thickness T1 is disposed adjacent the opening 67 in the platform 61 and the minimum thickness T2 opposes the maximum thickness and, as a result, is spaced from the opening. In one suitable embodiment, the maximum thickness T1 of the side wall 83 is between about 0.5 mm and about 6 mm. In the illustrated embodiment, for example, the maximum thickness T1 of the side wall 83 is about 2.5. Suitably, the minimum thickness T2 of the side wall 83 is between about 0.5 mm and about 5 mm. In the illustrated embodiment, for example, the minimum thickness T2 of the side wall 83 is about 1.25. As a result, a ratio of the maximum thickness T1 relative to the minimum thickness T2 is preferably between about 1 and 12. In the illustrated embodiment, for example, the ratio between the maximum thickness T1 and the minimum thickness T2 of the side wall 83 is approximately 2. It is contemplated that the maximum thickness T1 and the minimum thickness T2 can be equal (i.e., the side wall 83 of the first elliptical tubular plug 63 having a uniform thickness) without departing from some aspects of this disclosure.

With reference again to FIGS. 9-13, the second elliptical tubular plug 65 of the valve assembly 33 includes a base (or bottom) 87 and a side wall 89 extending up from the base. The base 87 and the side wall 89 cooperatively define an interior chamber 91 of the second elliptical tubular plug 65. As seen in FIGS. 10 and 13, the base 87 (and thus the side wall 89 extending therefrom) is angled relative to the longitudinal axis LA of the cup 1 such that the base slopes downward toward the central opening 67. In the illustrated embodiment, for example, the base 87 and thus the side wall 89 extending therefrom, which has a generally constant height, define an angle α' relative to the longitudinal axis LA of the cup between about 60 degrees and about 80 degrees (FIG. 10). In the illustrated embodiment, for example, the base 87 and the side wall 89 define an angle α' of about 70 degrees relative to the longitudinal axis LA of the cup 1. It is understood that the base 87 and the side wall 89 can be arranged in any suitable configuration. For example, in one suitable embodiment, the angle α' between the longitudinal axis LA of the cup 1 and the base 87 (and the side wall 89) can be 90 degrees so that the base is disposed in a planar orientation. In such an embodiment, the side wall 89 would not necessarily be canted. Rather, the side wall 89 can be oriented relative to the transverse axis TA of the cup 1.

With reference now to FIG. 11, the second elliptical tubular plug 65 has a major axis MA1 and a minor axis MA2. As a result, the maximum extent of the second elliptical tubular plug 65 along the major axis MA1 is greater than the maximum extent of the second elliptical tubular plug along the minor axis MA2. For example, in one suitable embodiment, the major axis A1 can be between 6 mm and 133 mm, more preferably between 16 mm and 66 mm, and even more preferably between 20 mm and 26 mm, and the minor axis A2 can be between 4 mm and 107 mm, more preferably between 8 mm and 53 mm, and even more preferably between 10 mm and 21 mm. Suitably, the ratio of the maximum extents between the major axis MA1 and the minor axis MA2 is between 1 and 10, more preferably between 1.2 and 5, and even more preferably between 1.5 and 2. Suitably, the ratio between the maximum extents of the major axis MA1 and the minor axis MA2 is greater than 1 and less than 10.

With reference now to FIGS. 11 and 13, the side wall 89 of the second elliptical tubular plug 65 varies in thickness. In other words, the thickness of the side wall 89 is not uniform but instead tapers from a maximum thickness T3 to a minimum thickness T4. As seen in FIG. 11, the maximum thickness T3 is disposed adjacent the opening 67 in the platform 61 and the minimum thickness T4 opposes the maximum thickness and, as a result, is spaced from the opening. In one suitable embodiment, the maximum thickness T3 of the side wall 89 is between about 1 mm and about 6 mm. In the illustrated embodiment, for example, the maximum thickness T3 of the side wall 89 is about 2.5 mm. Suitably, the minimum thickness T4 is between about 0.5 mm and about 5 mm. In the illustrated embodiment, for example, the minimum thickness T4 of the side wall 89 is about 1.25 mm. As a result, a ratio of the maximum thickness T3 relative to the minimum thickness T4 is preferably between about 1 and 12. In the illustrated embodiment, for example, the ratio between the maximum thickness T3 and the minimum thickness T4 is approximately 2. It is contemplated that the maximum thickness T3 and the minimum thickness T4 can be equal (i.e., the side wall 89 of the second elliptical tubular plug 65 having a uniform thickness) without departing from some aspects of this disclosure.

As seen in FIGS. 9-13, the valve assembly 33 including the first and second elliptical tubular plugs 63, 65 is free of slits or cuts. Thus, the valve assembly 33 does not include any passageways (e.g., slits, cuts) whatsoever that allow fluid (i.e., liquid or air) from passing through the valve assembly. Accordingly, the valve assembly 33 does not include any slits or cuts that can be potential causes for leaks. Moreover, slits and cuts within the valve assembly 33 can, depending on the material from which the valve assembly is made, stick together, become occluded during use, or otherwise become obstructed, which inhibits liquid from freely flowing through the slit or cut. Accordingly, the valve assembly 33 of the present disclosure is slit and cut free.

As seen in FIGS. 9-13, the second tubular plug 65 is a mirror image of the first elliptical tubular plug 63. Stated more broadly, the valve assembly 33 is symmetric about its transverse axis. As a result, the first elliptical tubular plug 63 can be selectively engaged with either the first elliptical socket 55 or the second elliptical socket 57, and the second tubular plug 65 can be selectively engaged with the other one of the first and second elliptical sockets. In the illustrated embodiment, the first elliptical socket 55 is sized and shaped relative to the first and second tubular plugs 63, 65 such that the first elliptical socket is received within the interior chamber 84, 87 of the respective plug (FIGS. 7 and 7A), and the second elliptical socket 57 is sized and shaped relative to the first and second tubular plugs such that the respective plug is received within second elliptical socket (FIGS. 7 and 7B).

Figure 7A:
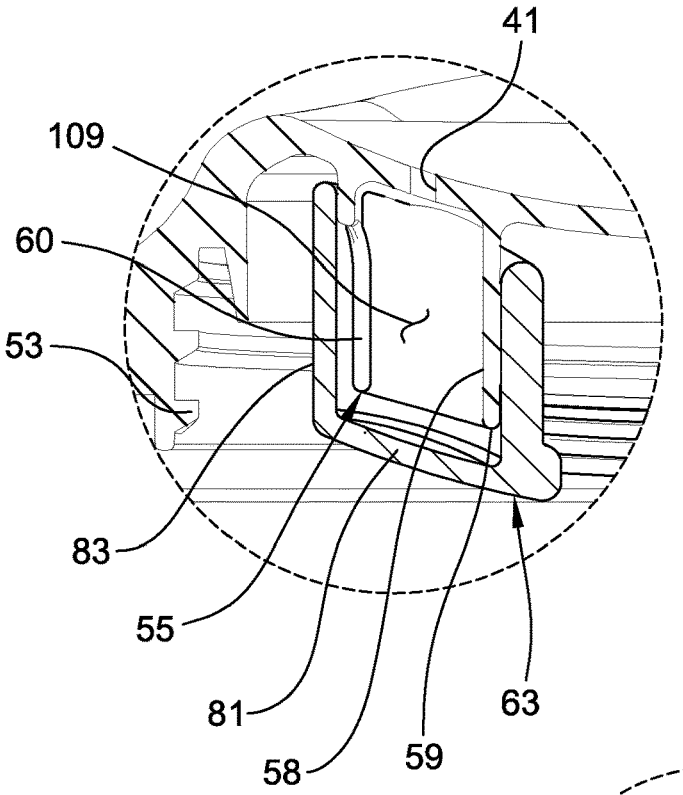
FIG. 7A is an enlarged fragmentary view of the cross-section illustrated in FIG. 7 taken from area "7A" of FIG. 7.
Figure 7B:
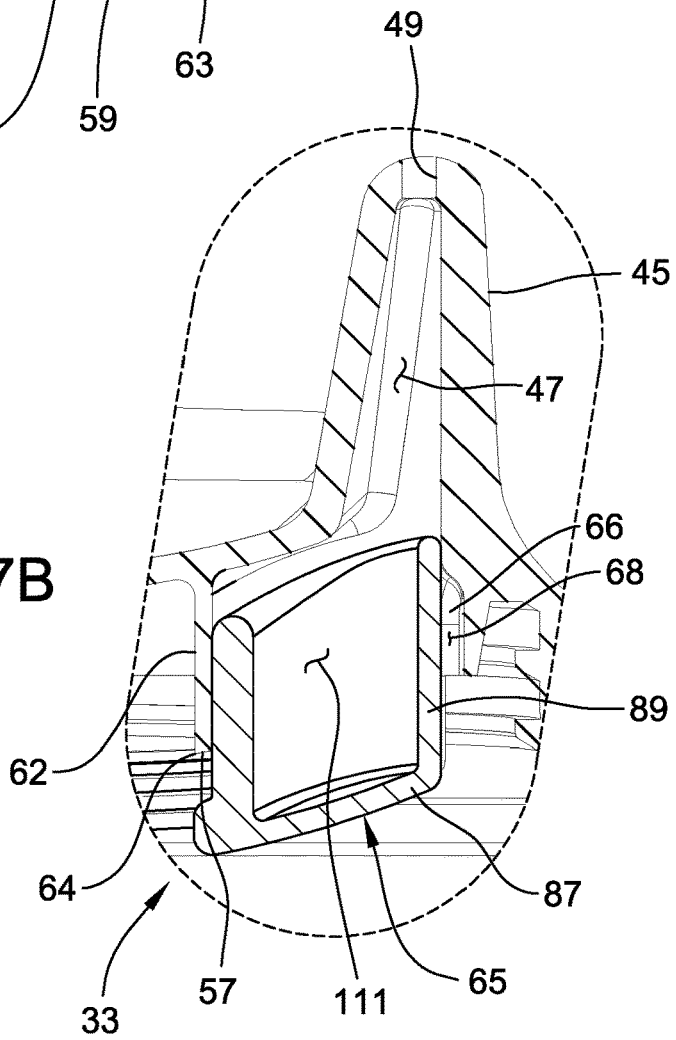
FIG. 7B is an enlarged fragmentary view of the cross-section illustrated in FIG. 7 taken from area "7B" of FIG. 7.

As seen in FIGS. 7, 7A and 7B, the closure member 31 and the valve assembly 33 cooperatively define a vent chamber 109 and a suction chamber 111. More specifically with respect to the vent chamber 109, the concaved upper portion 35 of the closure member 31, the first elliptical socket 55, and the base 81, 87 of one of the first and second elliptical tubular plugs 63, 65 cooperatively define the vent chamber when the valve assembly 33 is connected to the closure member. The aperture 41 in the upper portion 35 of the closure member 31 is in fluid communication with the vent chamber 109 for maintaining the vent chamber generally at ambient pressure. In the illustrated embodiment, the volume of the vent chamber 109 is approximately equal to the volume of the first elliptical socket 55. As seen in FIGS. 7 and 7A, the first (or second) elliptical tubular plug 63 is sized and shaped to receive the first elliptical socket 55 within its interior chamber 84. As a result, the cutout 60 in the first elliptical socket 55 is closed by the portion of the side wall 83 of the first (or second) elliptical tubular plug 63 having the minimum thickness T2. In addition, the inner surface of the side wall 83 of the first (or second) elliptical tubular plug 63 cooperates with the outer surface of the first elliptical socket 55 to form a seal. As seen in FIGS. 7 and 7A, the seal is defined by the vertical extending inner surface of the side wall 83 of the first (or second) elliptical tubular plug 63 and the vertical extending outer surface of the first elliptical socket 55. Thus, the seal separating the vent chamber 109 from the liquid chamber 29 of the container 3 is a vertical seal as seen in FIGS. 7 and 7A. In other words, the seal between the vent chamber 109 and the liquid chamber 29 of the container 3 extends parallel to the longitudinal axis LA of the cup 1. Thus, liquid within liquid chamber 29 of the container 3 is inhibited from leaking into the vent chamber 109, and air within the vent chamber 109 is inhibited under normal conditions from entering the liquid chamber 29 of the container.

As seen in FIGS. 7 and 7A, the first elliptical socket 55 shields a majority of the interior surface of the first (or second) elliptical tubular plug 63 from contact by ambient air within the vent chamber 109. In one suitable embodiment, the first elliptical socket 55 shields between about 60 percent and about 99 percent of the interior surface of the first elliptical tubular plug 63 from contact by ambient air within the vent chamber 109. In the illustrated embodiment, for example, the first elliptical socket 55 shields about 80 percent of the interior surface of the first elliptical tubular plug 63 from contact by ambient air. Accordingly, ambient air within the vent chamber 109 contacts and thus acts upon only a relatively small percentage of the interior surface of the first elliptical tubular plug 63 during use of the cup 1. Ambient air within the vent chamber 109 does, however, contact all (i.e., 100 percent) of the interior surface of the first elliptical socket 55.

With reference still to FIGS. 7 and 7A, the first (or second) tubular plug 63 shields a majority of the outer surface of the first elliptical socket 55 from contact by liquid held within the liquid chamber 29 of the container 3. In one suitable embodiment, the first elliptical tubular plug 63 shields between about 20 percent and about 100 percent of the exterior surface of the first elliptical socket 55 from contact by liquid within the liquid chamber 29 of the container 3. More suitably, the first elliptical tubular plug 63 shields between about 60 percent and about 98 percent of the exterior surface of the first elliptical socket 55 from contact by liquid within the liquid chamber 29 of the container 3. In the illustrated embodiment, for example, the first elliptical tubular plug 63 shields about 95 percent of the exterior surface of the first elliptical socket 55 from contact by liquid. Accordingly, in the illustrated embodiment, liquid within the liquid chamber 29 of the container 3 does not contact the exterior surface of the first elliptical socket 55. Liquid within the liquid chamber 29 of the container 3 can, however, contact all (i.e., 100 percent) of the exterior surface of the first elliptical tubular plug 63.

With respect to the suction chamber 111, the passageway 47 in the spout 45 of the closure member 31 and the inner chamber 91 of the second (or first) elliptical tubular plug 65 cooperatively define the suction chamber when the valve assembly 33 is connected to the closure member (FIGS. 7 and 7B). In the illustrated embodiment, the volume of the suction chamber 111 is approximately equal to the volume of the interior chamber 91 of the second elliptical tubular plug 65 plus the volume of the passageway in the spout 45. The opening 49 in the spout 45 of the closure member 31 is in fluid communication with the suction chamber 111 for allowing a user to apply a suction (i.e., vacuum) pressure to the suction chamber by sucking on the spout. The outer surface of the side wall 89 of the second (or the first) elliptical tubular plug 65 engage the inner surface of the second elliptical socket 57 of the closure member to form a seal between the suction chamber 111 and the liquid chamber 29 of the container 3. As seen in FIGS. 7 and 7B, the seal is defined by the vertical extending outer surface of the side wall 89 of the second elliptical tubular plug 65 and the vertical extending inner surface of the second elliptical socket 57. Thus, the seal separating the suction chamber 111 from the liquid chamber 29 of the container 3 is a vertical seal. In other words, the seal between the suction chamber 111 and the liquid chamber 29 of the container 3 extends parallel to the longitudinal axis LA of the cup 1. The seal inhibits liquid within the liquid chamber 29 of the container 3 from passing the valve assembly 33 and entering the suction chamber 111 under normal conditions (i.e., when a vacuum pressure is not being applied by a user).

With reference now to FIG. 7B, the cutout 66 in the second elliptical socket 57 forms the recess 68 between the exterior surface of the second tubular plug 65 (when captured by the second elliptical socket 57) and the inner surface of the inner socket 51. As seen in FIG. 7B, the portion of the side wall 89 of the second tubular plug 65 having a minimum thickness T4 defines one side of the recess 68 and the side wall engages the inner surface of the second elliptical socket 57 adjacent to and surrounding the cutout 66 therein.

As seen in FIGS. 7 and 7B, a majority of the interior surface of the second (or first) elliptical tubular plug 65 is arranged such that any suction force applied to the spout by the user of the cup acts on the interior surface of the second elliptical tubular plug. In one suitable embodiment, the suction force acts on between about 55 percent and about 100 percent of the interior surface of the second elliptical tubular plug 65. In the illustrated embodiment, for example, the second elliptical tubular plug 65 is arranged such that any suction force applied to the spout 45 by the user of the cup 1 acts on about 100 percent of the interior surface of the second elliptical tubular plug. The interior surface of the second elliptical socket 57 is shielded by the second elliptical tubular plug 65 and thus prevents any suction force applied to the spout 45 by the user from acting on the second elliptical socket.

With reference still to FIGS. 7 and 7B, the second elliptical socket 57 shields a majority of the outer surface of the second elliptical tubular plug 65 from contact by liquid held within the liquid chamber 29 of the container 3. In one suitable embodiment, the second elliptical socket 57 shields between about 55 percent and about 99 percent of the exterior surface of the second elliptical tubular plug 65 from contact by liquid within the liquid chamber 29 of the container 3. In the illustrated embodiment, for example, the second elliptical socket 57 shields about 76 percent of the exterior surface of the second elliptical tubular plug 65 from contact by liquid. Liquid within the liquid chamber 29 of the container 3 can, however, contact all (i.e., 100 percent) of the exterior surface of the second elliptical socket 57.

In the illustrated embodiment, the first elliptical tubular plug 63 of the valve assembly 33 receives the first elliptical socket 55 of the closure member 31, and the second elliptical tubular plug 65 is received within the second elliptical socket 57. However, the valve assembly 33, which as mentioned above is symmetric, can be selectively repositioned to change its orientation such that the second elliptical tubular plug 65 receives the first elliptical socket 55 of the closure member 31, and the first elliptical tubular plug 63 is received in the second elliptical socket 57.

Figure 14:
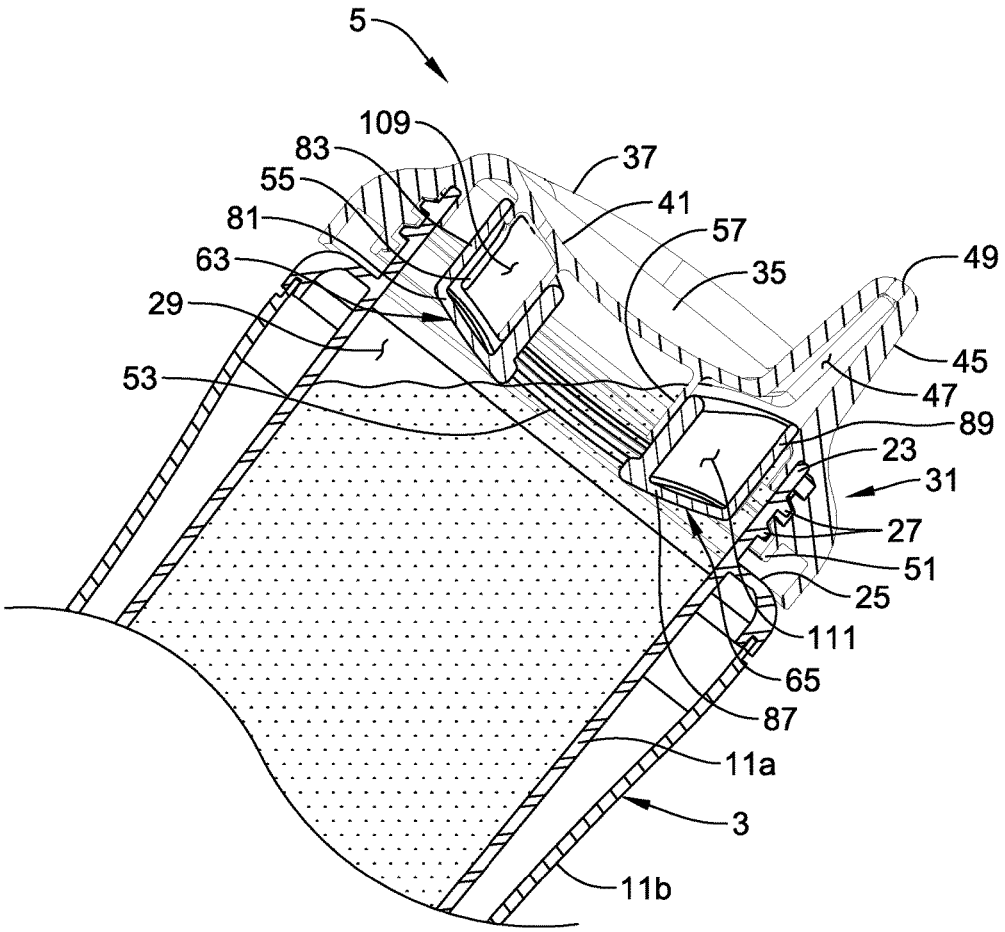
FIG. 14 is a fragmented, enlarged longitudinal cross-section of the leak resistant drinking cup, the cup being seen in a tilted, drinking position, the valve assembly being in the closed, sealed configuration thereby inhibiting liquid from exiting the cup.
Figure 15:
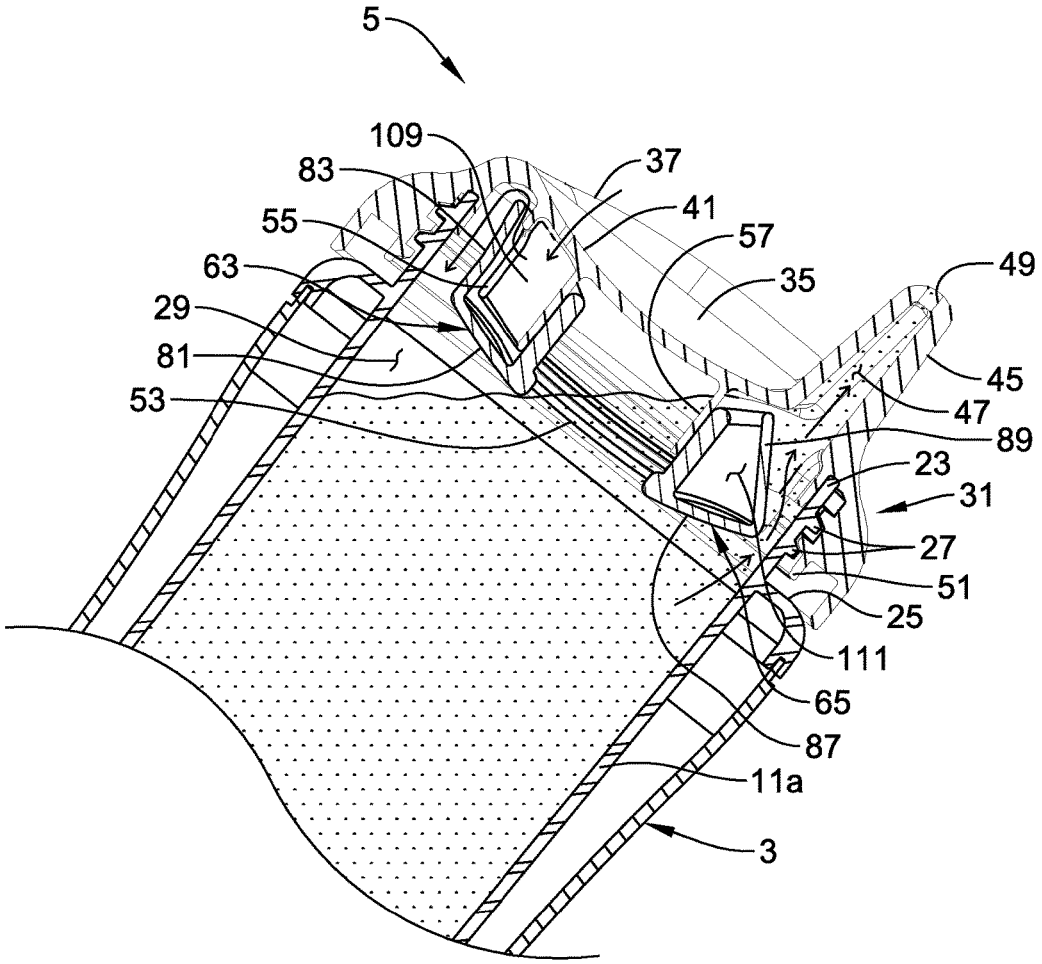
FIG. 15 is a fragmented, enlarged longitudinal cross-section similar to FIG. 14 but showing the valve assembly in an opened, unsealed configuration thereby allowing liquid to exit the cup.

Referring now to FIGS. 14 and 15, it is relatively easy for a small child (and more generally "a user") to get a drink out of the drinking cup 1 by placing her lips around the spout 45 so as to form a seal with the spout, tilting the cup so that liquid in the container 3 flows into contact with the second elliptical tubular plug 65, and sucking on the spout. It is understood, however, that liquid would flow into contact with the first elliptical tubular plug 63 if the valve assembly 33 was orientated in the opposite orientation such that the first elliptical tubular plug was received in the second elliptical socket 57. When the cup 1 is tilted to the user's mouth, liquid within the container 3 readily flows into the recess 68 between the exterior surface of the second tubular plug 65 (when captured by the second elliptical socket 57) and the inner surface of the inner socket 51 and into direct contact with the portion of the side wall 89 having the minimum thickness T4.

Sucking on the spout 45 of the closure member 31 removes air from the suction chamber 111 through the opening 49 in the spout and thereby applies vacuum pressure to the side wall 89 of the second elliptical tubular plug 65 as oriented in FIGS. 14 and 15. Upon a threshold vacuum being applied to the side wall 89, the side wall flexes inward, which moves the valve assembly 33 from a sealed, closed configuration (FIGS. 7, 7A, and 14), which inhibits liquid from passing the valve assembly 33, to an unsealed, opened configuration, which allows liquid to pass the valve assembly 33 (FIG. 15). FIG. 7A is an enlarged fragmentary view of the cross-section illustrated in FIG. 7 wherein the valve assembly 33 is in the sealed, closed configuration and not being acted upon in any manner. In other words, the valve assembly 33 is in its initial, rest state. As seen therein, the side wall 89 of the second elliptical tubular plug 65 is not deformed in anyway. As mentioned above, when the cup 1 is tilted as seen in FIG. 14, liquid within the container 3 readily flows into the recess 68 between the exterior surface of the second tubular plug 65 (when captured by the second elliptical socket 57) and the inner surface of the inner socket 51 and into direct contact with the portion of the side wall 89 having the minimum thickness T4. The vertical extending seal formed between the inner surface of the second elliptical socket 57 and the outer surface of the second elliptical tubular plug 65 is sufficient to inhibit liquid from leaking past the valve assembly 33 and into the suction chamber 111.

Vacuum pressure applied by the user to the second elliptical tubular plug 65 at or below (i.e., greater vacuum) the threshold vacuum causes at least a portion of the second elliptical tubular plug to flex inward toward the major axis A1 of the second elliptical tubular plug. More specifically and as illustrated in FIG. 15, vacuum pressure acting on the interior chamber 91 of the second elliptical tubular plug 65 causes the side wall adjacent the recess 68, which is the thinnest portion of the sidewall (i.e., the portion having the minimum thickness T4) to flex inward toward the major axis A1 of the second elliptical tubular plug as indicated by arrows in FIG. 15. As mentioned above, the portion of the side wall 89 of the second elliptical tubular plug 65 adjacent the recess is the portion of the side wall having its minimum thickness T4 and, as a result, more readily flexes when acted upon by a force compared to the thicker portions of the side wall. Once the side wall 89 is flexed (or otherwise moved or deformed) a sufficient amount, the liquid can pass the vertical extending seal formed between the valve assembly 33 and closure member 31 as also indicated by arrows in FIG. 15. More specifically, flexure of the side wall 89 of the second elliptical tubular plug 65 caused by vacuum pressure at or below the threshold pressure breaks the vertical extending seal and allows liquid within the container 3 to pass between the side wall of the second elliptical tubular plug 65 and the second elliptical socket 57 of the closure member 31. Thus, the user applying vacuum to the spout 45 at or above the threshold vacuum permits liquid to flow past the valve assembly 33 and the closure member 31 and into the passageway 47 of the spout 45. Once in the passageway 47, the liquid flows out through the opening 49 and into the user's mouth for drinking.

The amount of vacuum pressure (applied by the user sucking on the spout 45) needed to configure the valve assembly 33 from the sealed (or closed) configuration to its unsealed (or opened) configuration can be predetermined. Suitably, the amount of vacuum pressure needed to move the valve assembly 33 between the sealed and unsealed position is less than 5 inches of mercury. In one suitable embodiment, the amount of vacuum pressure needed to move the valve assembly 33 between the sealed and unsealed position is between 2 inches of mercury and 5 inches of mercury. In the illustrated embodiment, for example, the amount of vacuum pressure needed to move the valve assembly 33 between the sealed and unsealed position is about 3 inches of mercury.

Figure 16:
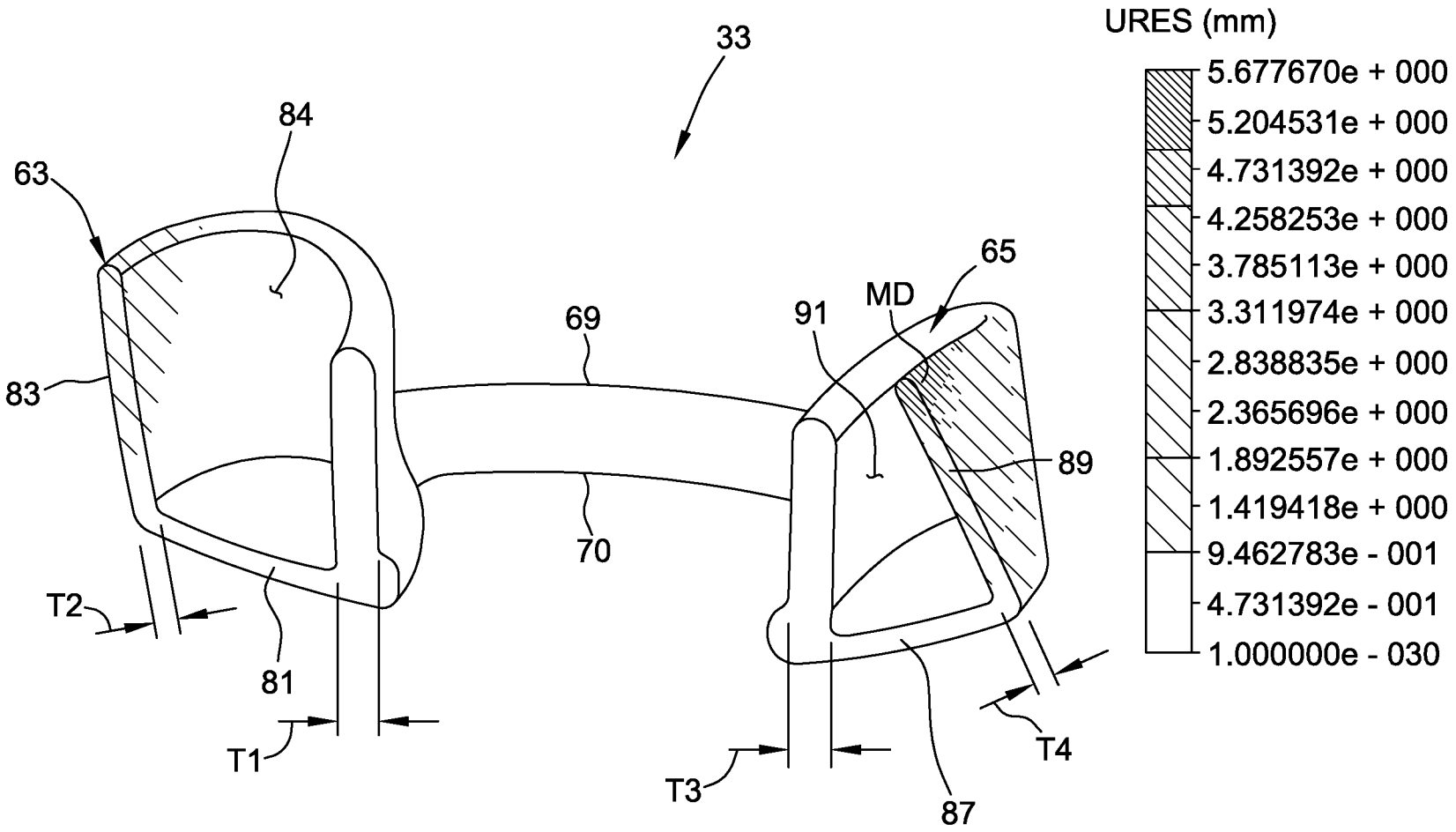
FIG. 16 is a vertical cross-section of the valve assembly similar to FIG. 13 but showing the valve assembly being acted upon by a vacuum pressure sufficient to move the valve assembly to the opened, unsealed configuration.

FIG. 16 is a perspective cross-section of the valve assembly 33 in isolation without any other components of the cup 1 being seen. The valve assembly 33 and, more specifically, the second elliptical tubular plug 65 is illustrated being acted on by vacuum pressure applied to the interior chamber 91 of the second elliptical tubular plug. As seen therein, the portion of the side wall 89 having the minimum thickness T4 flexes inward toward the major axis MA1 of the second elliptical tubular plug 65. More specifically, the portion of the side wall 89 having the minimum thickness T4 flexes a greatest extent along the minor axis MA2 of the second elliptical tubular plug 65 and near the uppermost extent of the side wall as viewed in FIG. 16. This point or area defines a maximum deflection MD of the second elliptical tubular plug 65. The extent or amount that the side wall 89 flexes tapers or lessens in all radial direction away from the maximum deflection MD. In the illustrated embodiment, the side wall 89 hinges along the major axis MA1 of the second elliptical tubular plug 65 such that about half of the second elliptical tubular plug (i.e., the half having the minimum thickness T4) flexes or is otherwise deformed. The portion of the side wall 89 having the maximum thickness T3 is sufficiently rigidified by the additional thickness such that the applied vacuum is insufficient to break the seal formed between outer surface of the portion of the side wall having the maximum thickness and the inner surface of the second elliptical tubular plug 65 (not shown in FIG. 16). As illustrated in FIG. 16, the half of the second elliptical tubular plug 65 having the side wall 89 with the maximum thickness T3 is not deflected or otherwise deformed. It is understood that the second elliptical tubular plug 65 can be configured to flex or otherwise deform a greater or lesser extent without departing from some aspects of this disclosure. It is further understood that, in the illustrated embodiment, the first elliptical tubular plug 63 is configured to act in the manner as the second elliptical tubular plug 65.

Once the user stops applying a vacuum pressure to the spout 45, the resiliency (or elasticity) of the valve assembly 33 causes the valve assembly to move from the unsealed position back to the sealed position. More specifically and relative to the orientation illustrated in FIGS. 14 and 15, terminating the vacuum pressure applied to the interior chamber 91 of the second elliptical tubular plug 65 results in the side wall 89 moving away from the major axis A1 of the second elliptical tubular plug and toward its prior position (shown in FIG. 14). As the side wall 89 moves back to its rest position (FIGS. 7 and 7B), the vertical extending seal formed between the outer surface of the second elliptical tubular plug 65 and the inner surface of the second elliptical socket 57 is reestablished to close the pathway between the valve assembly 33 and the closure member 31 and inhibit liquid from passing the valve assembly 33. Thus, the user by stopping to apply vacuum to the spout 45 causes the valve assembly 33 to return to its closed, sealed position and inhibits liquid from flowing past the valve assembly 33 into the passageway 47 of the spout.

As liquid is drawn out of the container 3 by the child, the pressure within the liquid chamber 29 of the container is reduced. Upon reaching a threshold vacuum pressure within the liquid chamber 29 of the container 3, the side wall 83 of the first elliptical tubular plug 63 having the minimum thickness T2 deflects thereby opening the vertical extending seal thereby allowing ambient air to pass between the inner surface of the side wall and the outer surface of the first elliptical socket 55 through the cutout 60 in the first elliptical socket, the aperture 41 in the closure member 31, and enter into the vent chamber 109 (see, e.g., FIGS. 15 and 16). Thus, from the vent chamber 109, ambient air passes between the valve assembly 33 and the closure member 31 to bring the pressure within the liquid chamber 29 to or approximately to ambient. Once the vacuum pressure within the liquid chamber 29 of the container 3 returns approximately to ambient, the vertical seal between the inner surface of the side wall 83 of the first elliptical tubular plug 63 and the outer surface of the first elliptical socket 55 is reestablished or returned to the sealed position inhibiting air from flowing into the chamber. It is understood that if the valve assembly 33 was in the opposite orientation, the second elliptical tubular plug 65 would deform in response to reaching a threshold vacuum pressure within the liquid chamber 29 of the container 3 and would close once the vacuum pressure within the liquid chamber 29 of the container returned approximately to ambient.

The illustrated drinking cup 1 can be repeatedly taken apart for thorough cleaning and reassembled for the next use. The separable components (as seen in FIG. 5) are all relatively large so that they are easy to handle. In addition, the number of separable components (i.e., three) is minimized to make assembly and reassembly of the cup 1 relatively easy without compromising the ability to clean each of the components. As mentioned above, the closure member 31, in the illustrated embodiment, can be removed from or secured to the container 3 via its threaded connection therewith. That is, the internal threads 53 of the inner socket 51 of the closure member 31 can be selectively engaged with and disengaged from the external threads 27 on the attachment collar 23 of the container 3. As noted above, it is understood that other forms and structures for making a releasable connection between the closure member 31 and the container 3 may be used. For instance, the closure member 31 may have a snap-fit connection with the container 3.

The valve assembly 33 can be selectively inserted into and pulled off of the closure member 31. More particularly, the valve assembly 33 can be releasibly coupled to the closure member 31 by engaging the first elliptical tubular plug 63 of the valve assembly with either of the elliptical sockets 55, 57 of the closure member, and the second elliptical tubular plug 65 of the valve assembly with the other elliptical socket of the closure member. Thus, in the illustrated embodiment, the valve assembly 33 has a friction fit (or interference fit) with the closure member 31. To remove the valve assembly 33 from the closure member 31, a user grabs the valve assembly and pulls downward to disengage the first elliptical tubular plug 63 of the valve assembly from one of the elliptical sockets 55, 57 of the closure member, and the second elliptical tubular plug 65 of the valve assembly from the other elliptical socket.

FIGS. 17-30 illustrate another suitable embodiment of a leak resistant drinking cup, which is generally indicated at 201. The cup 201 includes a container, which is generally indicated at 203, and a lid assembly, which is generally indicated at 205. The illustrated container 203 is substantially the same as the container 3 seen in FIG. 1 and described above except that the container 203 illustrated in FIGS. 17-21 is adapted to hold approximately 6 ounces of liquid. As a result, the container 203 will not be described in detail with respect to FIGS. 17-30.

Figure 17:
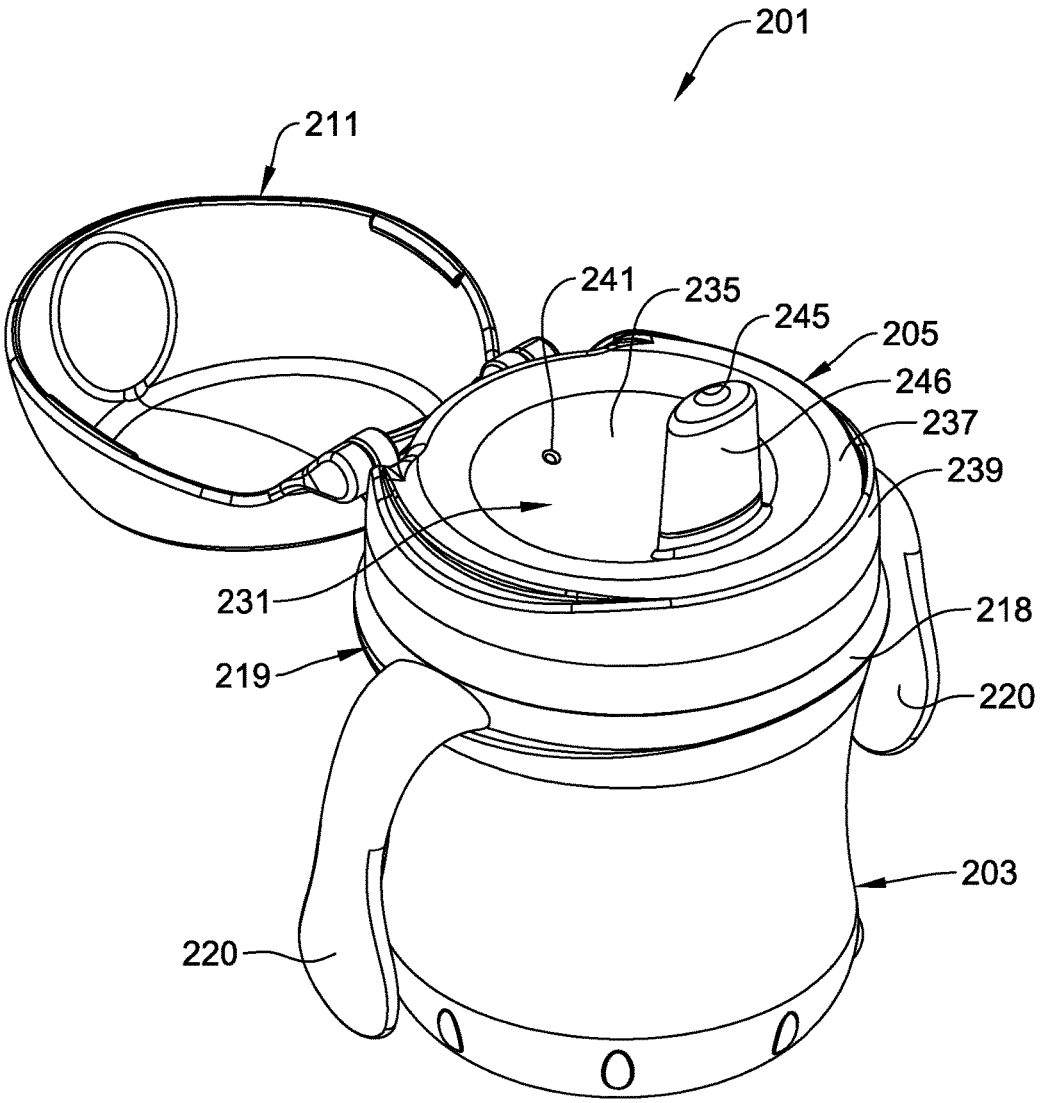
FIG. 17 is a perspective of another embodiment of a leak resistant drinking cup having a container and a lid assembly coupled to the container, the lid assembly in this embodiment having a cover illustrated in an opened position.
Figure 18:
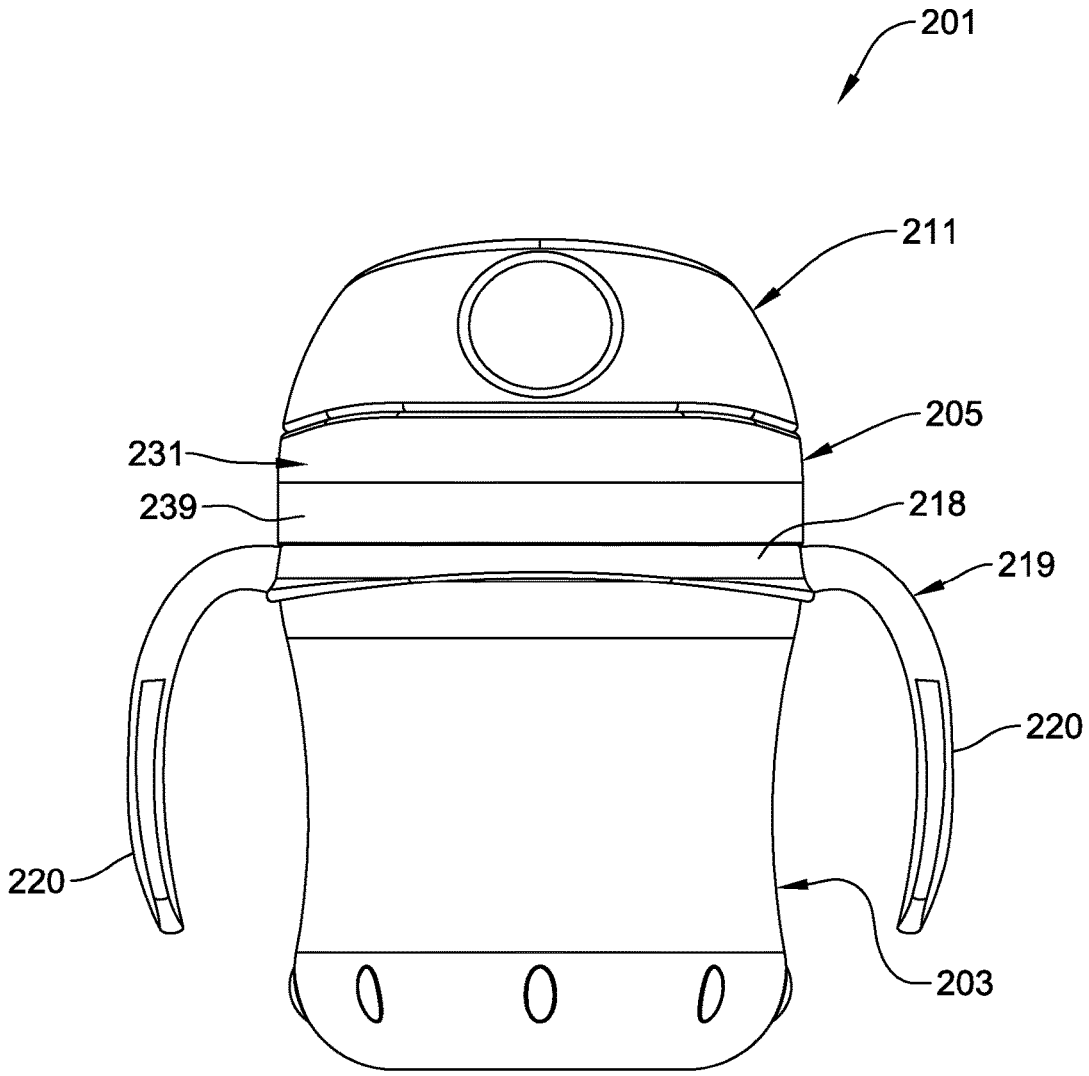
FIG. 18 is a front view of the cup of FIG. 17 but illustrating the cover in a closed position.
Figure 19:
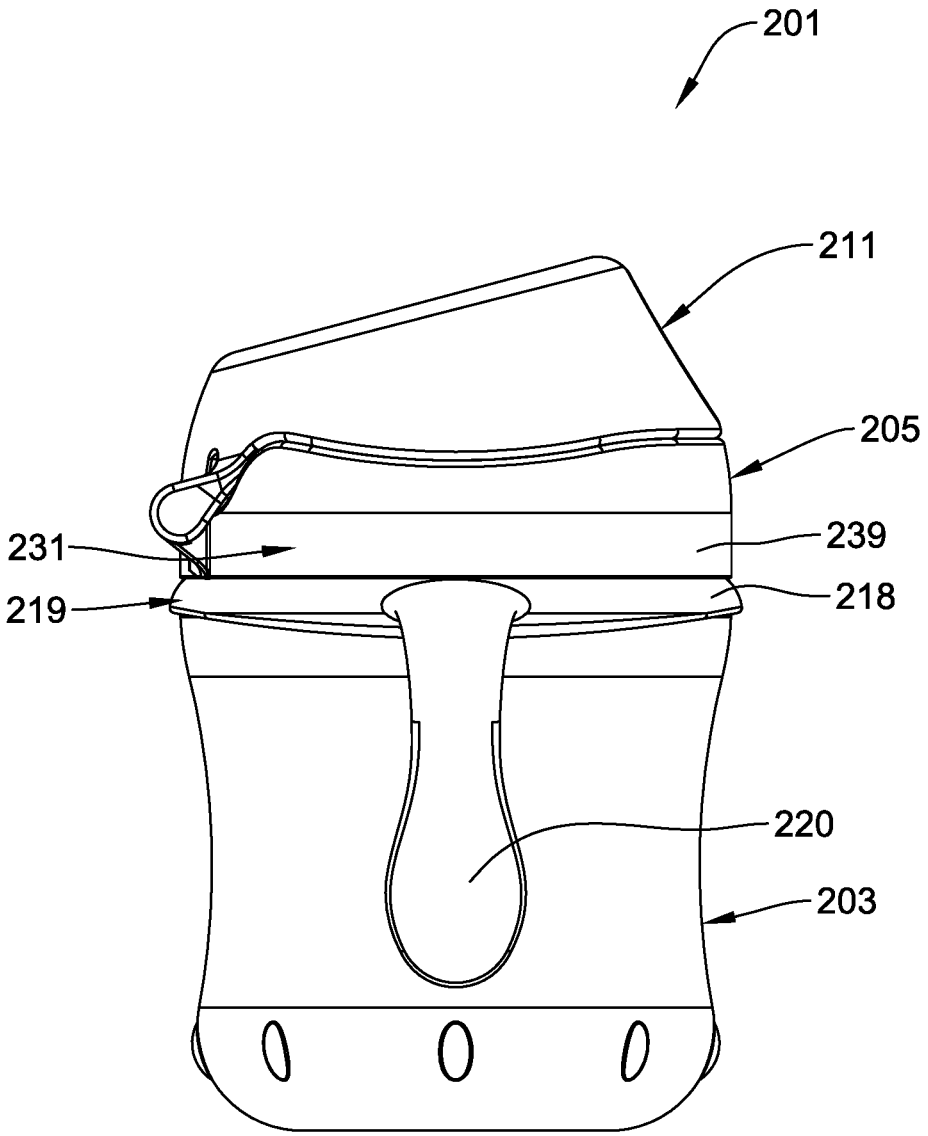
FIG. 19 is a side elevation of the cup seen in FIG. 18.
Figure 20:
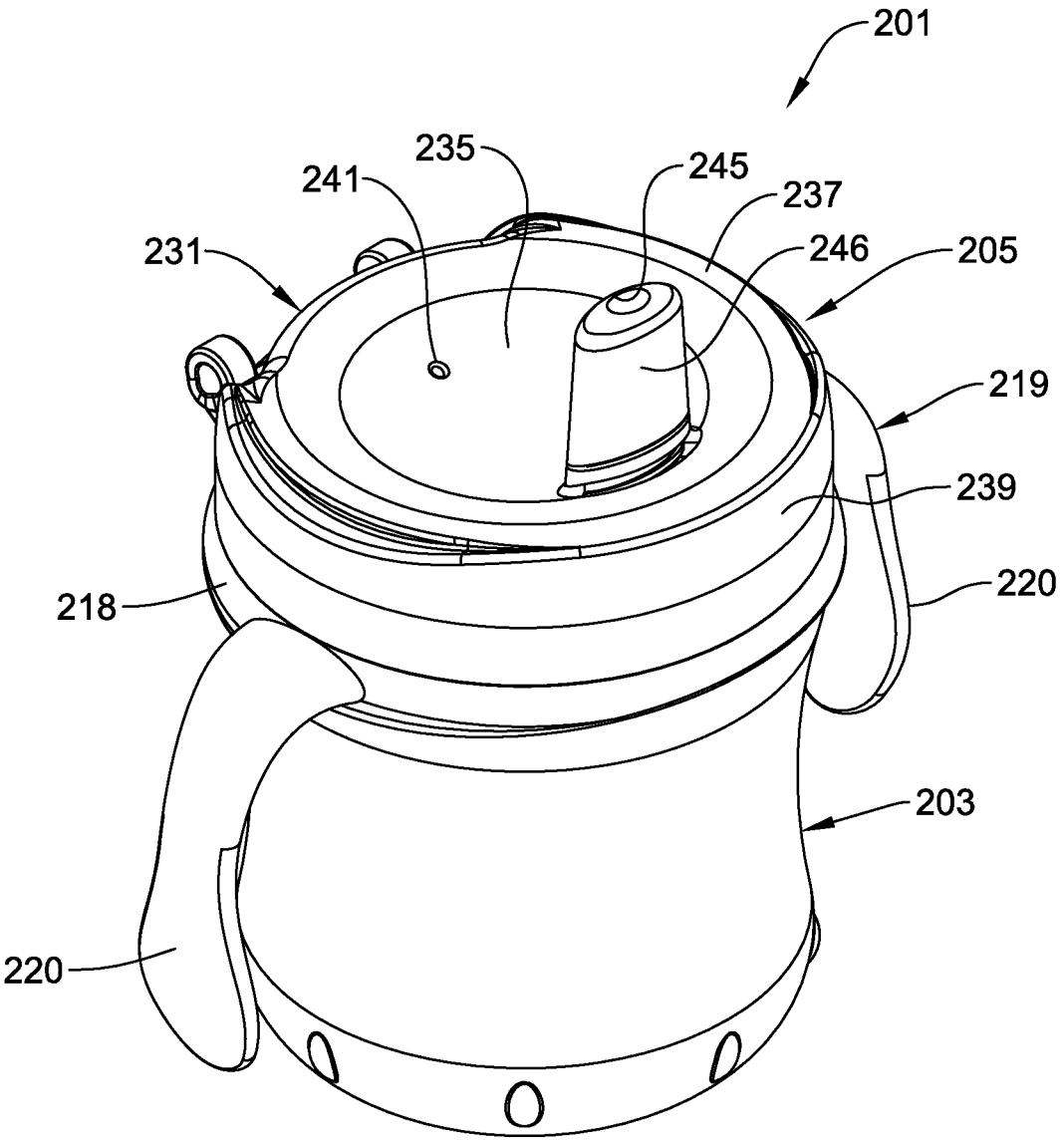
FIG. 20 is a perspective of the cup with the cover of the lid assembly removed.
Figure 21:
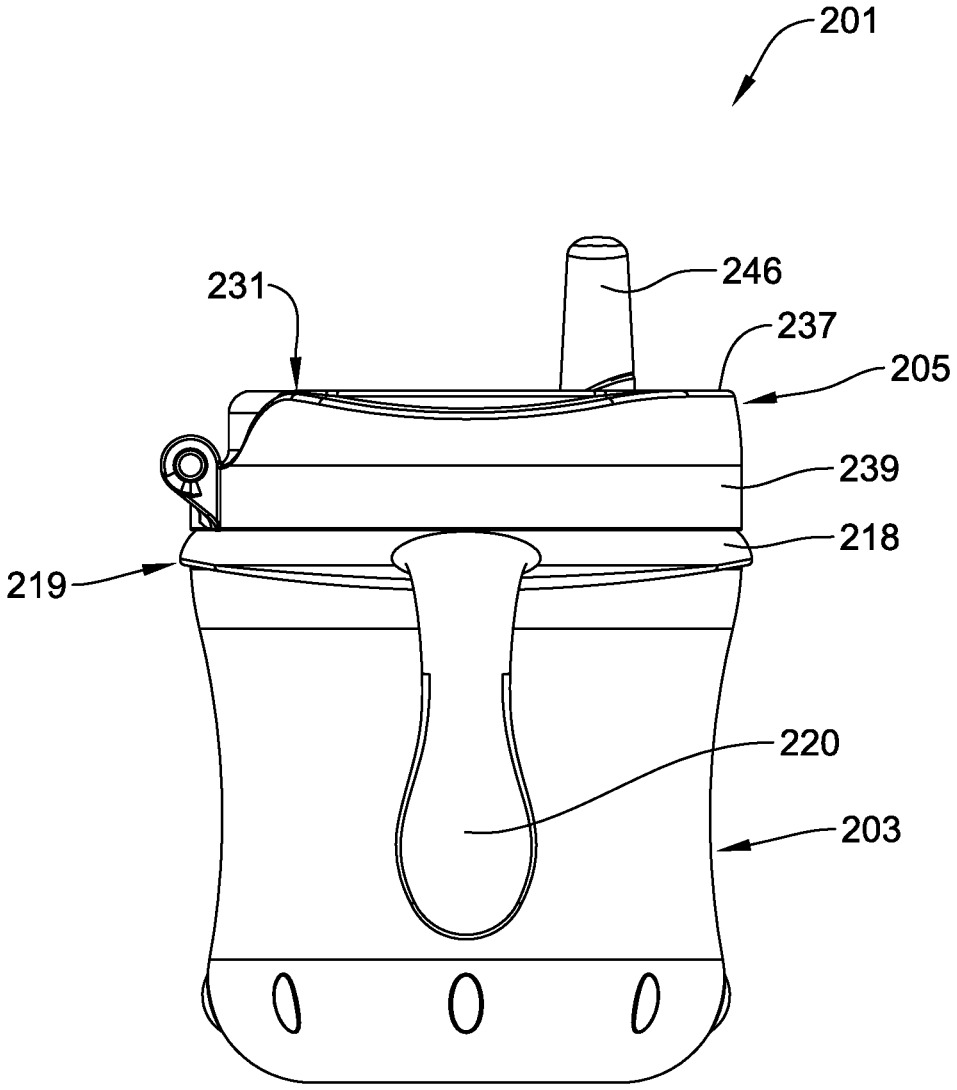
FIG. 21 is a side elevation of the cup seen in FIG. 20.

The lid assembly 205 of the cup 201 is adapted for removable attachment to the container 203 for selectively closing an open top of the container. The lid assembly 205, as illustrated in FIGS. 17-19, comprises a cover (or cap) 211 and a closure member 231. Both the cover 211 and the closure member 231 are indicated generally by their respective reference numbers. The cover 211 and the closure member 231 can be made of any suitable material. In one embodiment, the cover 211 and the closure member 231, for example, can be made of polypropylene. The cover 211 and the closure member 231 can be made in any desired color or colors, and may be transparent, translucent, or opaque.

In the illustrated embodiment, the cover 211 is hingedly connected to the closure member 231 and is selectively pivotable between a closed position (FIGS. 18 and 19) and an opened position (FIG. 17). The cover 211 can be selectively opened by manually pivoting the cover from the closed position to the opened position, and selectively closed by manually pivoting the cover from the opened position to the closed position. It is contemplated that in other suitable embodiments the cover 211 can be omitted or be fully removable from the closure member 231. In the illustrated embodiment, the cover 211 has a snap-fit with the closure member 231 to hold the cover in the closed position. It is contemplated that the cover 211 can be held in the closed position relative to the closure member 231 in any suitable manner (e.g., a latch and a catch). It is also contemplated that in other suitable embodiments the cover 211 can be omitted or be fully removable from the closure member 231.

As seen in FIGS. 17-21, the illustrated cup 201 includes a handle assembly, indicated generally at 219. The handle assembly 219 has an annular hub 218 and a pair of grips 220 extending outward and downward from the hub. The annular hub 218 is sized and shaped for engaging a shoulder of the container 203. When the annular hub 218 is placed into engagement with the container 203, the annular hub rests on the shoulder of the container and can be captured between the container and the closure member 231. The grips 220 of the handle assembly 219 are adapted for grasping by the user of the cup. It is contemplated that the handle assembly can include a single grip or can be omitted from the cup altogether. It is also contemplated that the handle assembly can be formed integral with the container 203 or the closure member 231.

Figure 22:
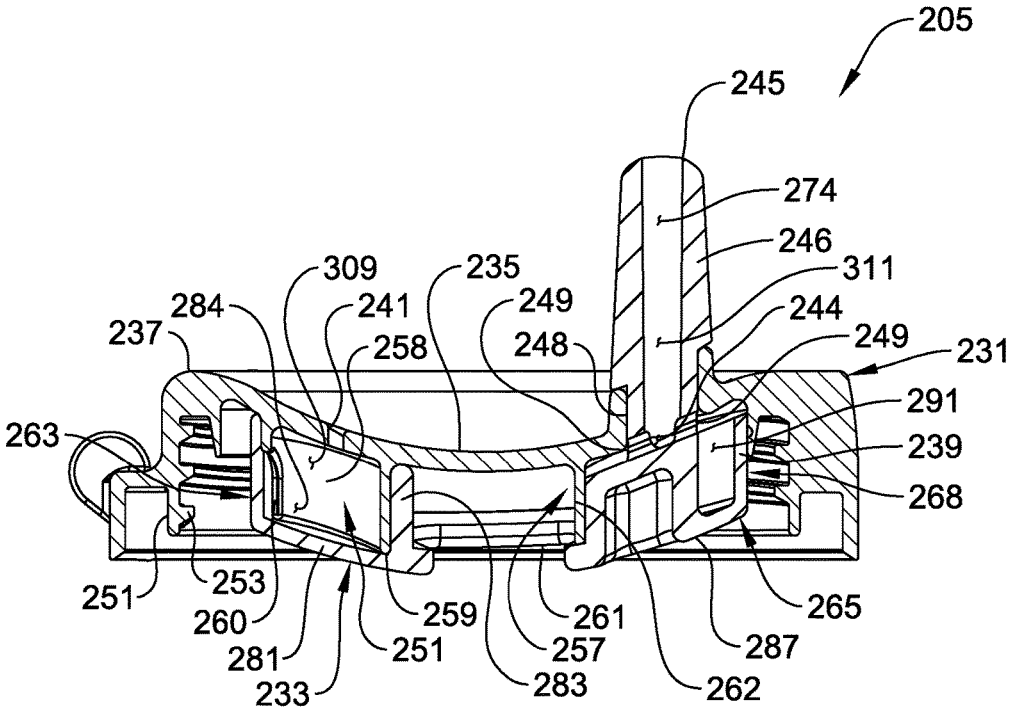
FIG. 22 is a vertical cross-section of the lid assembly illustrated in FIG. 21 with the lid assembly being removed from the container, the lid assembly including a closure member and a valve assembly secured to the closure member.
Figure 23:
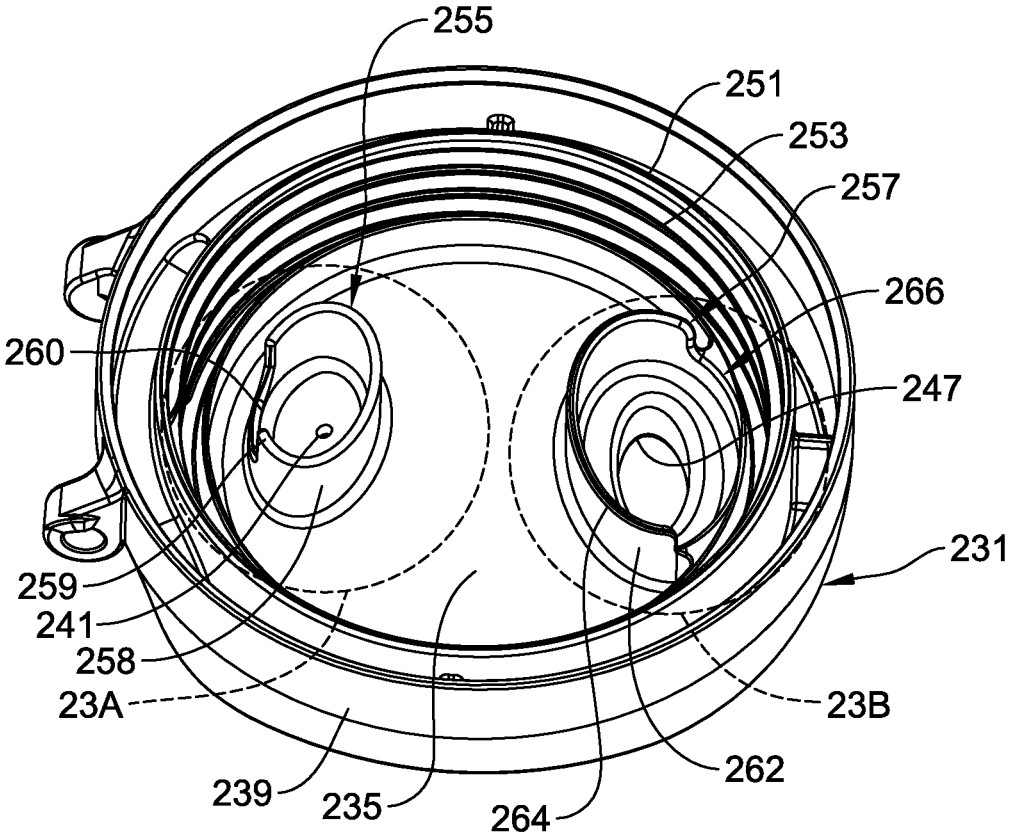
FIG. 23 is a bottom view of the closure member having the valve assembly removed therefrom.

With reference now to FIGS. 20-23, the closure member 231 of the lid assembly 205 includes a concaved, central upper portion 235, an annular ridge 237 circumscribing the central upper portion, and a peripheral skirt 239 depending downward from the annular ridge. As illustrated in FIG. 23, the closure member 231 has an inner socket 251 including internal threads 253 for releasably mating with external threads of the container 203. Thus, the closure member 231 can be selectively attached and detached from the container 203 via the threaded connection between the internal threads 253 of the inner socket 251 and the external threads of the container. It is understood, however, that the closure member 231 can be selectively attached and detached from the container 203 using any suitable connection (e.g., snap-fit).

Figure 23A:
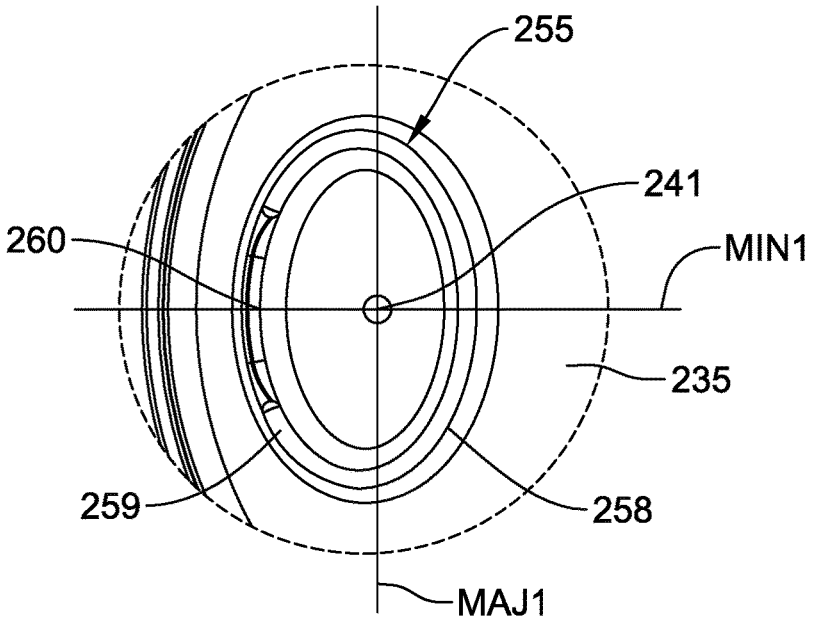
FIG. 23A is an enlarged fragmentary view of the cross-section illustrated in FIG. 23 taken from area "23A" of FIG. 23.
Figure 23B:
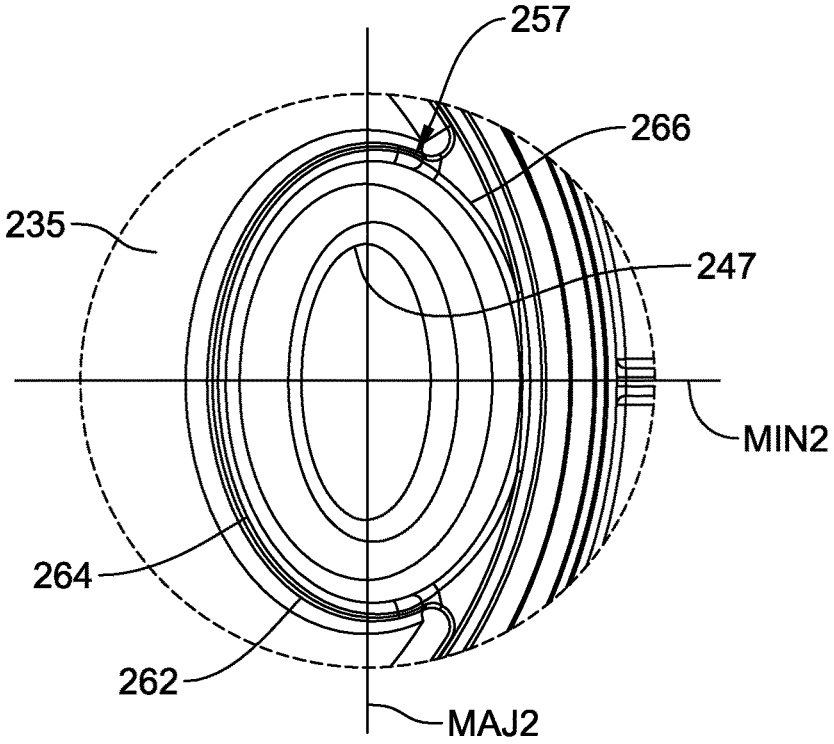
FIG. 23B is an enlarged fragmentary view of the cross-section illustrated in FIG. 23 taken from area "23B" of FIG. 23.

The closure member 231, as illustrated in FIGS. 23 and 23A, also includes a first interior, elliptical socket 255 extending downward from the central upper portion 235 and circumscribing a vent aperture 241. In the illustrated embodiment, the vent aperture 241 in the upper portion 235 is generally centered relative to the first elliptical socket 255. The vent aperture 241 allows air to pass through the closure member 231 and into the container 203 when the closure member is attached to the container. With reference now to FIGS. 23 and 23B, a second elliptical socket 257 is spaced from and opposed the first elliptical socket 255. In this embodiment, the second elliptical socket 257 extends downward from the central upper portion 235 and circumscribes an elliptical opening 247 in the upper portion 235. In the illustrated embodiment, the elliptical opening 247 in the upper portion 235 is generally centered relative to the first elliptical socket 255.

As seen in FIGS. 23 and 23A, the first elliptical socket 255 includes a major axis MAJ1, a minor axis MIN1, and a wall 258 extending downward from the upper portion 235 of the closure member 231. The wall 258 defines a perimeter of the socket, a height, and an outer, free edge 259 of the first elliptical socket 255. In the illustrated embodiment, the first elliptical socket 255 is generally elliptical in shape. However, it is contemplated that the first elliptical socket 255 can have any suitable shape including, but not limited to, circular, ovate, rectangular.

The wall 258 includes a generally U-shaped cutout 260 that extends, in the illustrated embodiment, from the outer edge 259 to approximate the upper portion 235. In the embodiment seen in FIG. 23A, the cutout 260 does not extend through the entire height of the wall 258. In other words, in the illustrated embodiment, the cutout 260 has a height that is less than the height of the wall 258. Suitably, the cutout 260 extends between approximately 25 percent and 99 percent the height of the wall 258. More suitably, the cutout 260 extends between approximately 50 percent and 90 percent the height of the wall 258. For example, in the illustrated embodiment, the cutout 260 extends approximately 75 percent the height of the wall 258.

Moreover, in the illustrated embodiment, the cutout 260 extends less than 50 percent of the perimeter of the wall 258. Suitably, the cutout 260 extends between about 5 percent and about 45 percent the perimeter of the wall 258. More suitably, the cutout 260 extends between about 15 percent and about 35 percent the perimeter of the wall 258. In one preferred embodiment and as seen in the illustrated embodiment, the cutout 260 extends approximately 22 percent the perimeter of the wall 258. It is contemplated that the cutout 260 in the wall 258 can have any suitable size and shape without departing from some aspects of this disclosure. That is, the cutout 260 can be other than generally U-shaped without departing from some aspects of this disclosure.

In the illustrated embodiment, the cutout 260 in the wall 258 of the first elliptical socket 255 is disposed adjacent to but spaced from the inner socket 251. In addition, the cutout 260 is generally aligned with the minor axis MIN1 of the first elliptical socket 255 such that approximately half of the cutout 260 is disposed on one side of the minor axis and the other half of the cutout is disposed on the opposite side of the minor axis. It is understood, however, that the cutout 260 can have different locations relative to the inner socket 251 and the minor axis MIN1. That is, the cutout 260 can be disposed along any suitable portion of the wall 258.

With reference now to FIG. 23B, the second elliptical socket 257 includes a major axis MAJ2, a minor axis MIN2, and a wall 262 extending downward from the upper portion 235 of the closure member 231. The wall 262 defines a perimeter, a height, and an outer, free edge 264 of the second elliptical socket 257. In the illustrated embodiment, the second elliptical socket 257 is generally elliptical in shape. However, it is contemplated that the second elliptical socket 257 can have any suitable shape including, but not limited to, circular, ovate, rectangular. It is further contemplated that is some suitable embodiments the second elliptical socket 257 can have a generally shape that differs from the generally shape of the first elliptical socket 255.

The wall includes a generally U-shaped cutout 266 that extends, in the illustrated embodiment, from the edge towards, but spaced from, the upper portion. In the embodiment seen in FIGS. 23 and 23A, the cutout 266 does not extend through the entire height in the wall 262. In other words, in the illustrated embodiment, the cutout 266 has a height that is less than the height of the wall 262. Suitably, the cutout 266 extends between approximate approximately 25 percent and 90 percent the height of the wall 262. More suitably, the cutout 266 extends between approximately 50 percent and 80 percent the height of the wall 262. For example, in the illustrated embodiment, the cutout 266 extends approximately 75 percent the height of the wall 262.

Moreover, in the illustrated embodiment, the cutout 266 extends less than 50 percent of the perimeter of the wall 262. Suitably, the cutout 266 extends between about 5 percent and about 45 percent the perimeter of the wall 262. In one suitable embodiment, the cutout 266 has a width (as measured along the perimeter of the wall 262) between about 2.5 mm and about 22.1 mm and, more suitably, between about 5 mm and about 17 mm. In the illustrated embodiment, for example, the cutout has a width of approximately 12 mm. It is contemplated that the cutout 266 in the wall 262 can have any suitable size and shape without departing from some aspects of this disclosure. That is, the cutout 266 can be other than generally U-shaped without departing from some aspects of this disclosure.

In the illustrated embodiment, the second elliptical socket 257 intersects the inner socket 251 such that the wall of the second elliptical socket and the inner socket 251 are connected. More specifically and as seen in FIGS. 23 and 23B, the inner socket 251 closes the cutout 266 in the second elliptical socket 257. Thus, the wall 262 of the second elliptical socket 257 and the inner socket 251 cooperatively define a recess 268 (FIG. 22). In addition, the cutout 266 is generally aligned with the minor axis MIN2 of the second elliptical socket 257 such that approximately half of the cutout is disposed on one side of the minor axis and the other half of the cutout is disposed on the opposite side of the minor axis. It is understood, however, that the cutout 266 can have different locations relative to the inner socket 251 and the minor axis MIN2. That is, the cutout 266 can be disposed along any suitable portion of the wall 262.

The first elliptical socket 255 and the second elliptical socket 257 of this embodiment are sized and shaped to facilitate attachment of the valve assembly 233 to the closure member 231 in a single orientation as described in more detail below. It is noted that in the illustrated embodiment the first elliptical socket 255 and the second elliptical socket 257 have generally the same shape but different sizes. That is, both the first and second elliptical sockets 255, 257 are elliptical. However, the first elliptical socket 255 is smaller in size than the second elliptical socket 257. It is understood that the sockets 255, 257 can have any suitable size or shape. It is also understood that the sockets 255, 257 can have different sizes and shapes relative to each other without departing from some aspects of this disclosure.

As described in more detail below, the valve assembly 233 is operable to block the flow of liquid from the liquid chamber of the container 203 to thereby inhibit liquid being spilled from the cup 201. As also described in more detail below, the valve assembly 233 can be deflected, flexed, or otherwise reconfigured by application of vacuum pressure applied by a user drinking from the cup 201 to permit liquid in the container 203 to flow past the valve assembly and out of the cup. In addition and as described in more detail below, the valve assembly 233 is further operable to block the flow of air into the liquid chamber of the container 203 but can be deflected, flexed, or otherwise reconfigured by application of vacuum pressure applied by a user drinking from the cup 201 to permit air to flow past the valve assembly and into the container. Thus, the valve assembly 233 disclosed herein regulates both the flow of liquid from the container 203 and the flow of air into the container.

Figure 24:
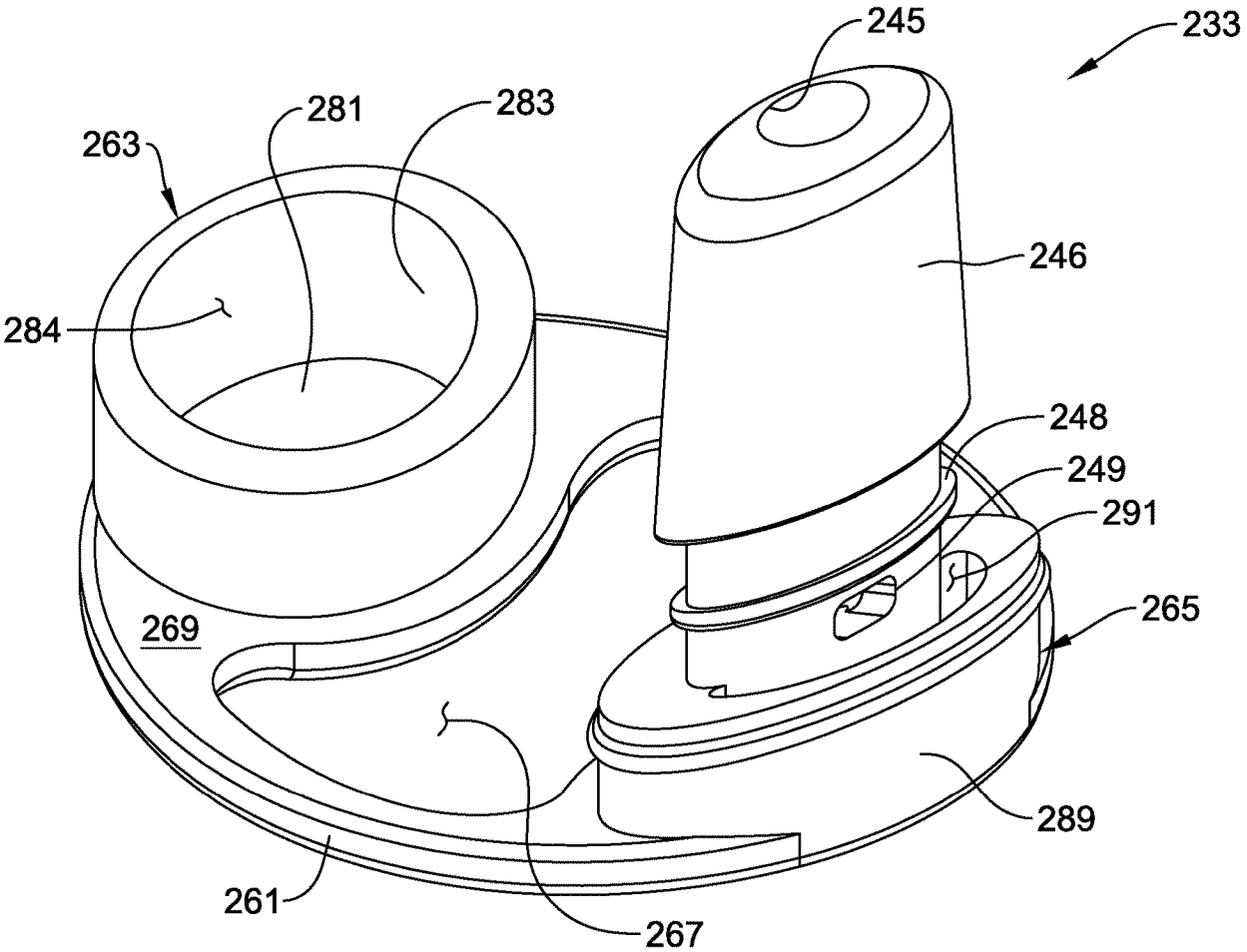
FIG. 24 is a perspective of the valve assembly of the lid assembly removed from the closure member.
Figure 25:
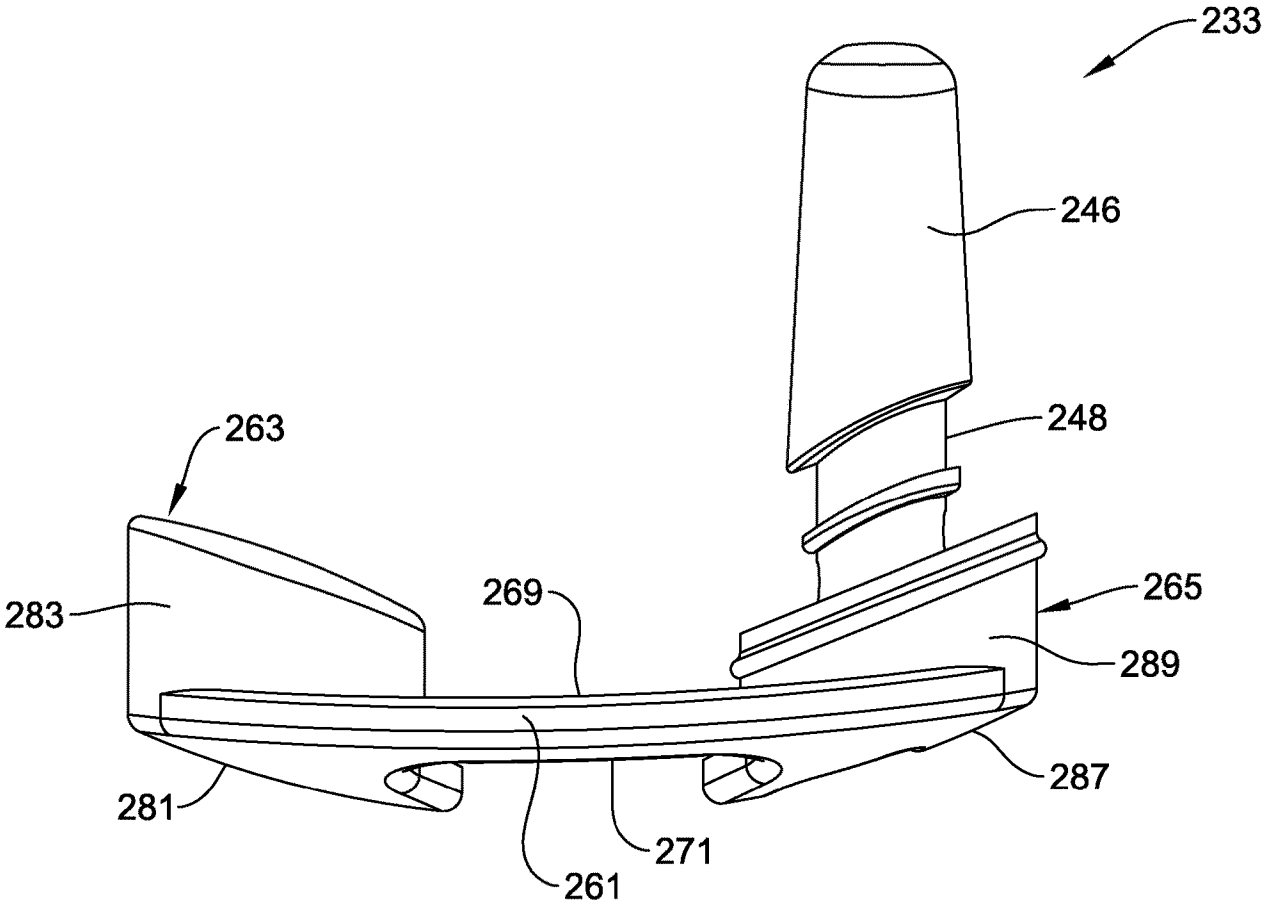
FIG. 25 is a side elevation of the valve assembly.
Figure 26:
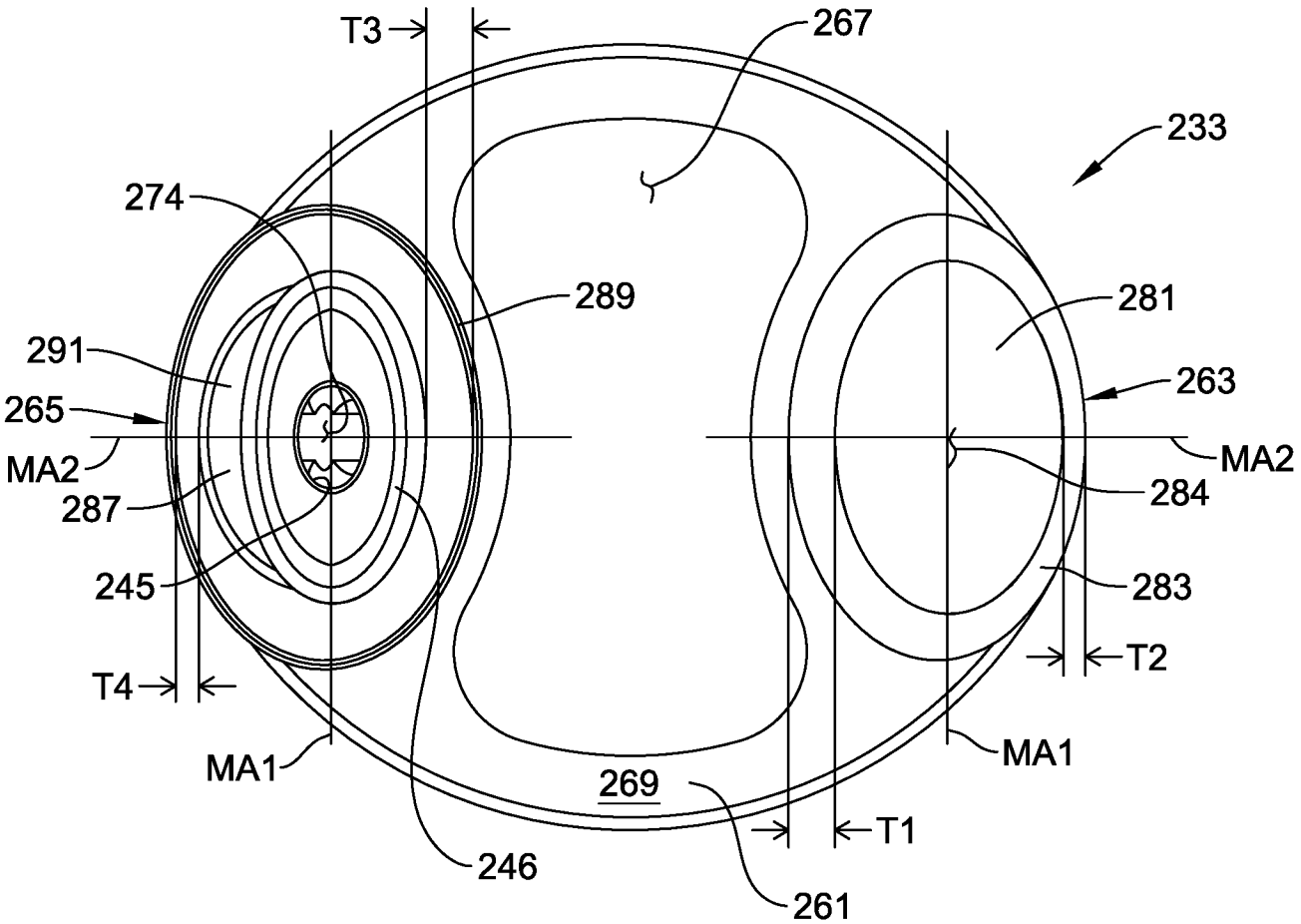
FIG. 26 is a top view of the valve assembly.
Figure 27:
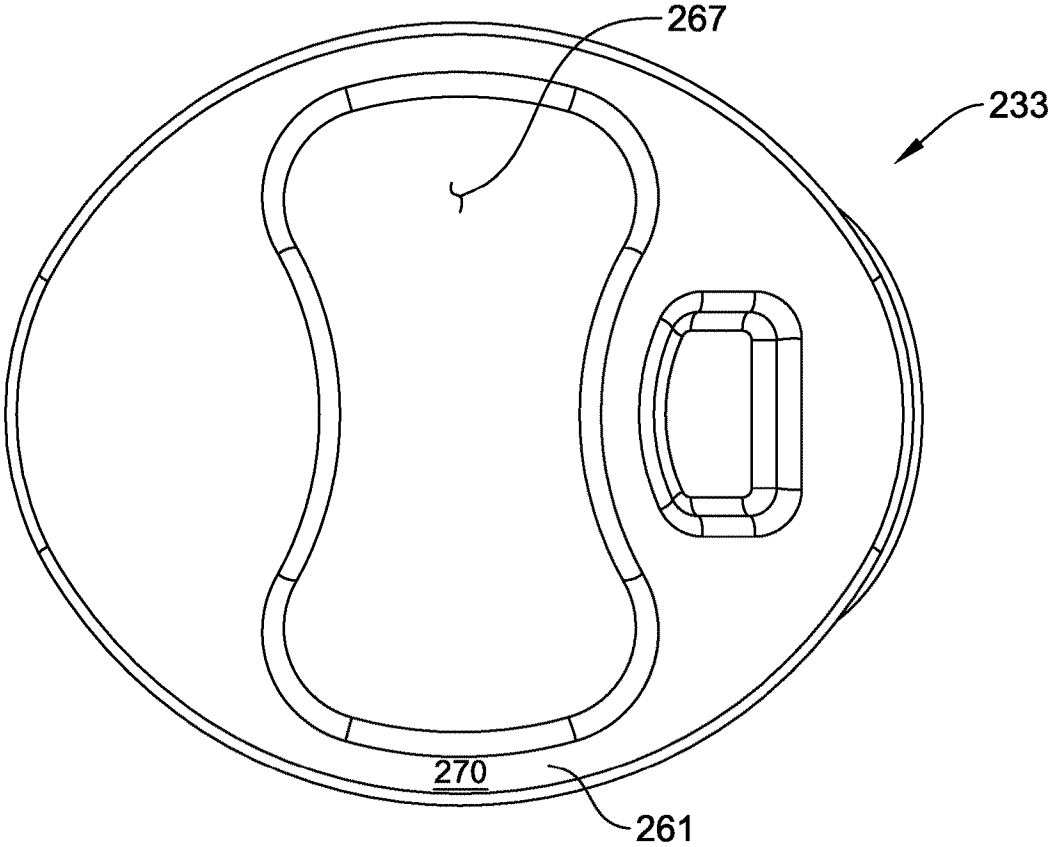
FIG. 27 is a bottom view of the valve assembly.

As illustrated in FIGS. 24-27, the valve assembly 233 includes a generally ovate or racetrack-shaped base 261, a first elliptical tubular plug, indicated generally at 263, adapted to couple to the first elliptical socket 255 of the closure member 231, and a second elliptical tubular plug, indicated generally at 265, adapted to couple to the second elliptical socket 257 of the closure member. As best seen in FIGS. 26 and 27, the ovate platform 261 includes a relatively large central opening 267, an upper surface 269 (FIG. 26), and a lower surface 270 (FIG. 27). In the illustrated embodiment, the opening 267 is generally hourglass shaped but it is understood that the opening can have any suitable size or shape. It is also understood that in some suitable embodiments, the opening 267 can be omitted.

With reference now to FIGS. 24-26, the first elliptical tubular plug 263 of the valve assembly 233 includes a base (or bottom) 281 and a side wall 283 extending up from the base. The base 281 and the side wall 283 cooperatively define an interior chamber 284 of the plug 263. As seen in FIG. 25, the base 281 (and thus the side wall 283 extending therefrom) is angled relative to the longitudinal axis LA of the cup 201 such that the base slopes downward toward the central opening 267. It is understood that the base 281 and the wall 283 can be arranged in any suitable configuration. With reference now to FIG. 26, the first elliptical tubular plug 263 has a major axis MA1 and a minor axis MA2. As a result, the maximum extent of the first elliptical tubular plug 263 along the major axis MA1 is greater than the maximum extent of the first elliptical tubular plug along the minor axis A2. With reference now to both FIGS. 22 and 26, the side wall 283 of the first elliptical tubular plug 263 varies in thickness. In other words, the thickness of the side wall 283 is not uniform but instead tapers from a maximum thickness T1 to a minimum thickness T2. As seen in FIG. 26, the maximum thickness T1 is disposed adjacent the opening 267 in the platform 261 and the minimum thickness T2 opposes the maximum thickness and, as a result, is spaced from the opening.

Figure 28:
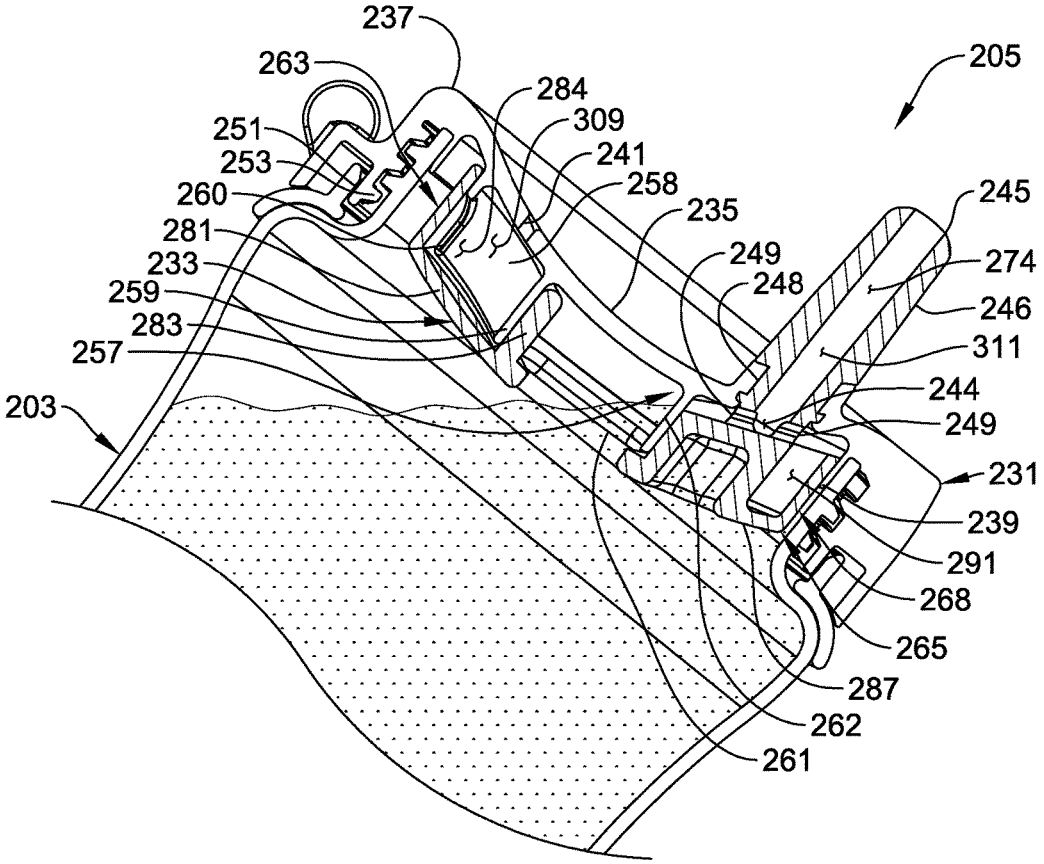
FIG. 28 is a fragmented, enlarged longitudinal cross-section of the leak resistant drinking cup, the cup being seen in a tilted, drinking position, the valve assembly being in the closed, sealed configuration thereby inhibiting liquid from exiting the cup.
Figure 29:
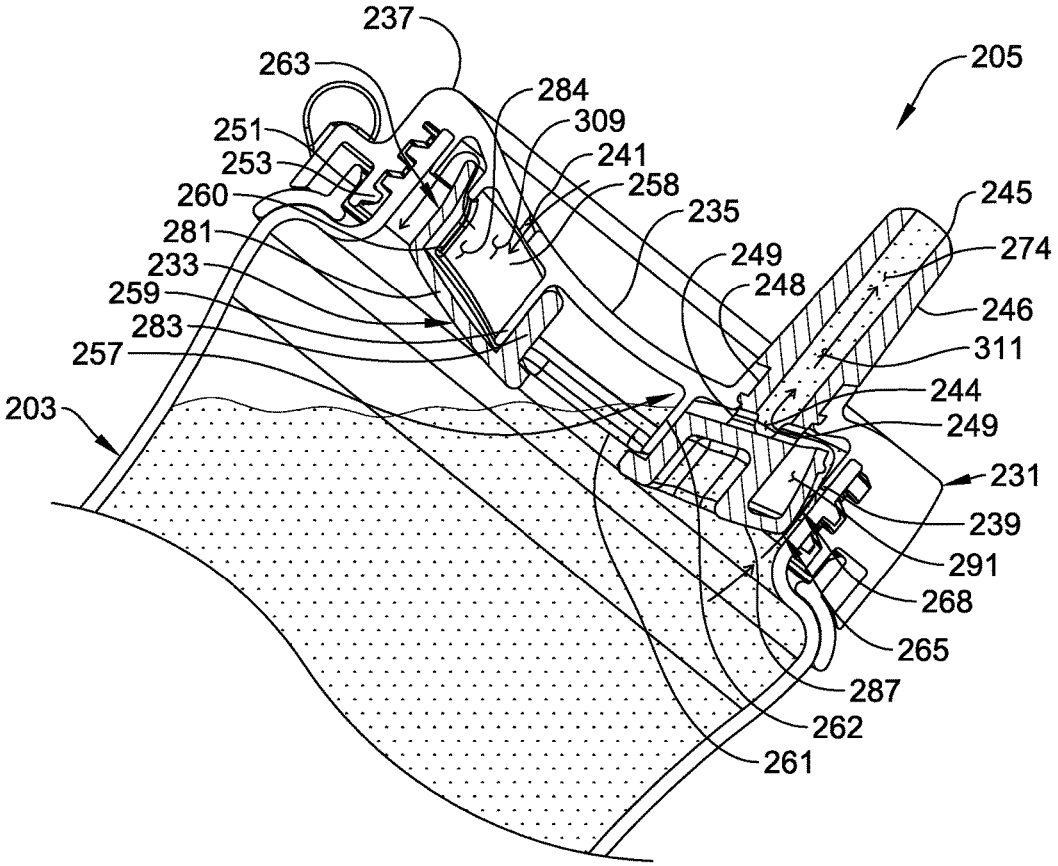
FIG. 29 is a fragmented, enlarged longitudinal cross-section similar to FIG. 28 but showing the valve assembly in an opened, unsealed configuration thereby allowing liquid to exit the cup.
Figure 30:
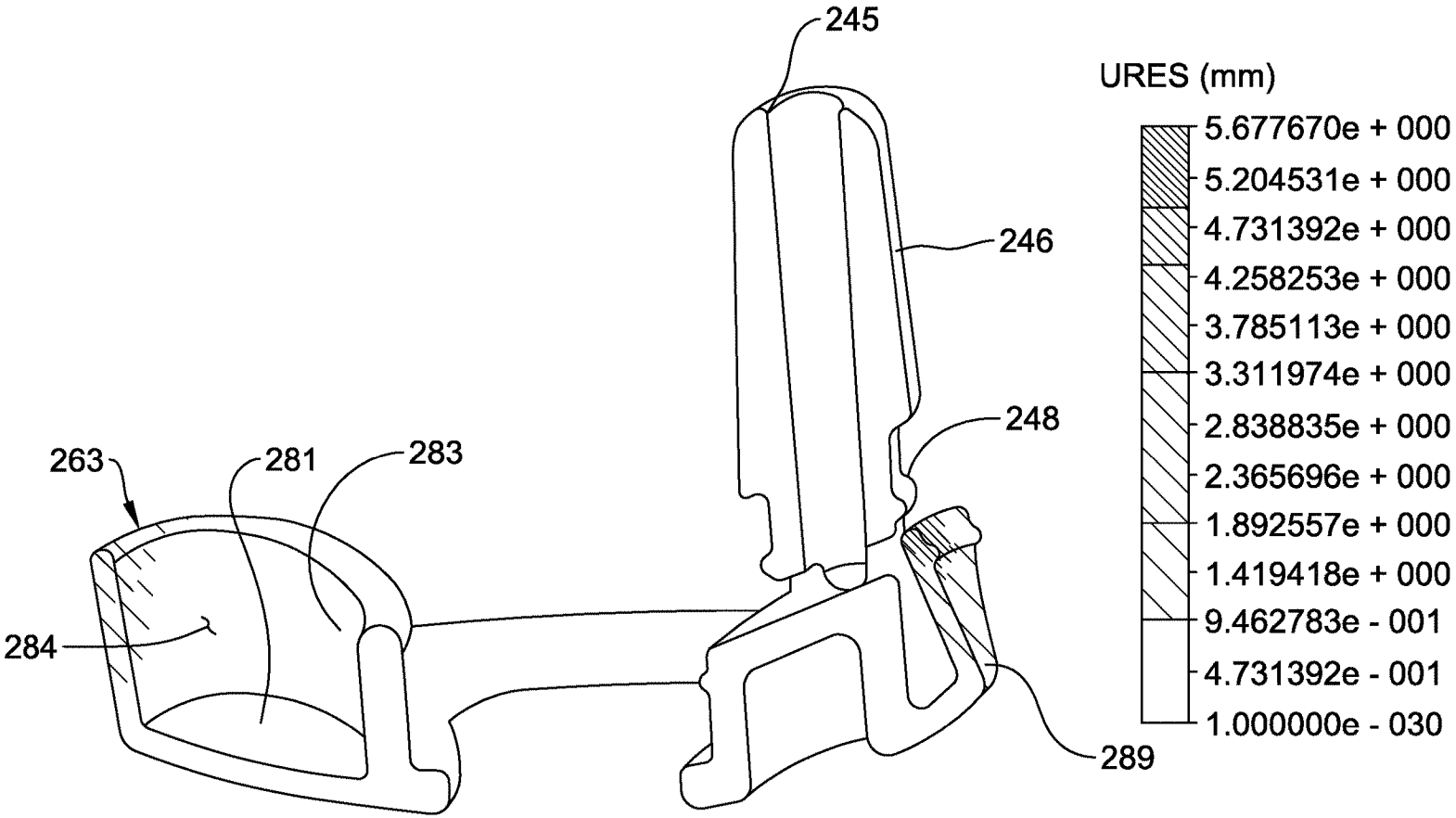
FIG. 30 is a vertical cross-section of the valve assembly showing the valve assembly being acted upon by a vacuum pressure sufficient to move the valve assembly to the opened, unsealed configuration.

As seen in FIGS. 24-27, the second elliptical tubular plug 265 of the valve assembly 233 includes a base (or bottom) 287, a side wall 289 extending up from the base, and a spout 246 (broadly, a "liquid discharge member") projecting up from the side wall. The spout 246 is sized and shaped for projecting up through the elliptical opening 247 in the closure member 231 when the valve assembly 233 and the closure member are engaged. The spout 246 includes a circumscribing recess 248 for capturing a portion of the closure member 231 adjacent the elliptical opening 247 therein (see, e.g., FIG. 22). The spout 246, as best seen in FIGS. 28-30, includes a transverse passageway 244 that extends through the entire width of the spout, a longitudinal passageway 274 in fluid communication with the transverse passageway, and an opening 245 at the distal end of the longitudinal passageway for allowing liquid to exit or discharge the drinking cup 201. It is understood that the liquid discharge member can be other than a spout, e.g., an elliptical opening similar to the elliptical opening 247 in the closure member 231.

With reference again to FIGS. 22 and 26, the base 287 and the side wall 289 cooperatively define an interior chamber 291 of the second elliptical tubular plug 265. The interior chamber 291 is disposed adjacent the spout 246. In the illustrated embodiment, the interior chamber 291 of the second elliptical tubular plug 265 is generally crescent shaped but it is understood that the interior chamber can have any suitable shape.

With reference still to FIGS. 22 and 26, the side wall 289 of the second elliptical tubular plug 265 varies in thickness. In other words, the thickness of the side wall 289 is not uniform but instead tapers from a maximum thickness T3 to a minimum thickness T4. As seen in FIG. 26, the maximum thickness T3 is disposed adjacent the opening 267 in the platform 261 and the minimum thickness T4 opposes the maximum thickness and, as a result, is spaced from the opening. In one suitable embodiment, the maximum thickness T3 of the side wall 289 is between about 1 mm and about 6 mm. In the illustrated embodiment, for example, the maximum thickness T3 of the side wall 289 is about 2.5 mm. Suitably, the minimum thickness T3 is between about 0.5 mm and about 5 mm. In the illustrated embodiment, for example, the minimum thickness T4 of the side wall 289 is about 1.25 mm. As a result, a ratio of the maximum thickness T3 relative to the minimum thickness T4 is preferably between about 1.5 and about 12 and, more preferably, between about 1.25 and 2.25. In the illustrated embodiment, for example, the ratio between the maximum thickness T3 and the minimum thickness T4 is approximately 2. It is contemplated that the maximum thickness T3 and the minimum thickness T4 can be equal (i.e., the side wall 289 of the second elliptical tubular plug 265 having a uniform thickness) without departing from some aspects of this disclosure.

As seen in FIG. 22, the closure member 231 and the valve assembly 233 cooperatively define a vent chamber 309 and a suction chamber 311. More specifically with respect to the vent chamber 309, the concaved upper portion 235 of the closure member 231, the first elliptical socket 255, and the base 281 of the first elliptical tubular plugs 263 cooperatively define the vent chamber when the valve assembly 233 is connected to the closure member. The aperture 241 in the upper portion 235 of the closure member 231 is in fluid communication with the vent chamber 309 for maintaining the vent chamber generally at ambient pressure. In the illustrated embodiment, the volume of the vent chamber 309 is approximately equal to the volume of the first elliptical socket 255. As seen in FIG. 22, the first elliptical tubular plug 263 is sized and shaped to receive the first elliptical socket 255 within its interior chamber 284. As a result, the cutout 260 in the first elliptical socket 255 is closed by the portion of the side wall 283 of the first elliptical tubular plug 263 having the minimum thickness T2. In addition, the inner surface of the side wall 283 of the first elliptical tubular plug 263 cooperates with the outer surface of the first elliptical socket 255 to form a seal. As seen in FIG. 22, the seal is defined by the vertical extending inner surface of the side wall 283 of the first elliptical tubular plug 263 and the vertical extending outer surface of the first elliptical socket 255. Thus, the seal separating the vent chamber 309 from the liquid chamber of the container 203 is a vertical seal. In other words, the seal between the vent chamber 309 and the liquid chamber of the container 203 extends parallel to the longitudinal axis LA of the cup 201. Thus, liquid within liquid chamber of the container 203 is inhibited from leaking into the vent chamber 309, and air within the vent chamber 309 is inhibited under normal conditions from entering the liquid chamber of the container.

As seen in FIG. 22, the first elliptical socket 255 shields a majority of the interior surface of the first elliptical tubular plug 263 from contact by ambient air within the vent chamber 309. Accordingly, ambient air within the vent chamber 309 contacts and thus acts upon only a relatively small percentage of the interior surface of the first elliptical tubular plug 263 during use of the cup 201. Ambient air within the vent chamber 309 does, however, contact all (i.e., 100 percent) of the interior surface of the first elliptical socket 255. Moreover, the first elliptical tubular plug 263 shields a majority of the outer surface of the first elliptical socket 255 from contact by liquid held within the liquid chamber of the container 3. Accordingly, in the illustrated embodiment, liquid within the liquid chamber of the container 203 does not contact the exterior surface of the first elliptical socket 255. Liquid within the liquid chamber of the container 203 can, however, contact all (i.e., 100 percent) of the exterior surface of the first elliptical tubular plug 263.

With respect to the suction chamber 311, the passageways 244, 247 in the spout 45 of the valve assembly 233 and the interior chamber 284 defined by the base 281 and the side wall 283 of the second elliptical tubular plug 265 define the suction chamber. The opening 249 in the spout 246 of the valve assembly 233 is in fluid communication with the suction chamber 311 for allowing a user to apply a suction (i.e., vacuum) pressure to the suction chamber by sucking on the spout. The outer surface of the side wall 289 of the second elliptical tubular plug 265 engages the inner surface of the second elliptical socket 257 of the closure member 231 to form a seal between the suction chamber 311 and the liquid chamber of the container 203. As seen in FIG. 22, the seal is defined by the vertical extending outer surface of the side wall 289 of the second elliptical tubular plug 265 and the vertical extending inner surface of the second elliptical socket 257. Thus, the seal separating the suction chamber 311 from the liquid chamber of the container 203 is a vertical seal. In other words, the seal between the suction chamber 311 and the liquid chamber of the container 203 extends parallel to the longitudinal axis LA of the cup 201. The seal inhibits liquid within the liquid chamber of the container 203 from passing the valve assembly 233 and entering the suction chamber 311 under normal conditions (i.e., when a vacuum pressure is not being applied by a user).

With reference still to FIG. 22, the cutout 266 in the second elliptical socket 257 forms the recess 268 between the exterior surface of the second elliptical tubular plug 265 (when captured by the second elliptical socket) and the inner surface of the inner socket 251. As seen in FIG. 22, the portion of the side wall 289 of the second elliptical tubular plug 265 having a minimum thickness T4 defines one side of the recess 268 and the side wall engages the inner surface of the second elliptical socket 257 adjacent to and surrounding the cutout 266 therein.

A majority of the interior surface of the second elliptical tubular plug 265 is arranged such that any suction force applied to the spout by the user of the cup acts on the interior surface of the second elliptical tubular plug that defines the interior chamber 284. Suction forces applied by the user to the spout act on the suction chamber 311 (i.e., the passageways 244, 247 in the spout 45 of the valve assembly 233 and the interior chamber 284 defined by the base 281 and the side wall 283 of the second elliptical tubular plug 265 in the illustrated embodiment). The interior surface of the second elliptical socket 257 is shielded by the second elliptical tubular plug 265 and thus prevents any suction force applied to the spout 246 by the user from acting on the second elliptical socket. With reference still to FIG. 22, the second elliptical socket 257 shields a majority of the outer surface of the second elliptical tubular plug 265 from contact by liquid held within the liquid chamber of the container 203. Liquid within the liquid chamber of the container 203 can, however, contact all (i.e., 100 percent) of the exterior surface of the second elliptical socket 257.

As indicated above, the first elliptical tubular plug 263 of the valve assembly 233 receives the first elliptical socket 255 of the closure member 231, and the second elliptical tubular plug 265 is received within the second elliptical socket 257. Thus, in this embodiment, the valve assembly 233 can only be engaged with the closure member 231 in a single orientation.

Referring now to FIGS. 28 and 29, it is relatively easy for a small child (and more generally "a user") to get a drink out of the drinking cup 201 by placing her lips around the spout 246 of the valve assembly 233 so as to form a seal with the spout, tilting the cup so that liquid in the container 203 flows into contact with the second elliptical tubular plug 265, and sucking on the spout. When the cup 201 is tilted to the user's mouth, liquid within the container 203 readily flows into the recess 268 between the exterior surface of the second elliptical tubular plug 265 and the inner surface of the inner socket 251 and into direct contact with the portion of the side wall 289 of the second elliptical tubular plug having the minimum thickness T4.

Sucking on the spout 246 removes air from the suction chamber 311 through the opening 249 in the spout and thereby applies vacuum pressure to the side wall 289 of the second elliptical tubular plug 265. Upon a threshold vacuum being applied to the side wall 289, the side wall flexes inward, which moves the valve assembly 233 from a sealed, closed configuration (FIG. 28), which inhibits liquid from passing the valve assembly, to an unsealed, opened configuration, which allows liquid to pass the valve assembly (FIG. 29). As seen in FIG. 28, the valve assembly 233 is in the sealed, closed configuration but with liquid acting on the exterior surface of the side wall 289 of the second elliptical tubular plug 265 as indicated by arrows. As mentioned above, when the cup 201 is tilted as seen in FIG. 28, liquid within the container 203 readily flows into the recess 268 between the exterior surface of the second elliptical tubular plug 265 (when captured by the second elliptical socket 257) and the inner surface of the inner socket 251 and into direct contact with the portion of the side wall 289 having the minimum thickness T4. The vertical extending seal formed between the inner surface of the second elliptical socket 257 and the outer surface of the second elliptical tubular plug 265 is sufficient to inhibit liquid from leaking past the valve assembly 233 and into the suction chamber 311.

Vacuum pressure applied by the user to the second elliptical tubular plug 265 at or below (i.e., greater vacuum) the threshold vacuum causes at least a portion of the second elliptical tubular plug to flex inward toward the major axis A1 of the second elliptical tubular plug. More specifically and as illustrated in FIG. 29, vacuum pressure acting on the interior chamber 291 of the second elliptical tubular plug 265 causes the side wall adjacent the recess 268, which is the thinnest portion of the sidewall (i.e., the portion having the minimum thickness T4) to flex inward toward the major axis A1 of the second elliptical tubular plug as indicated by arrows. As mentioned above, the portion of the side wall 289 of the second elliptical tubular plug 265 adjacent the recess is the portion of the side wall having its minimum thickness T4 and, as a result, more readily flexes when acted upon by a force compared to the thicker portions of the side wall. Once the side wall 289 is flexed (or otherwise moved or deformed) a sufficient amount, the liquid can pass the vertical extending seal formed between the valve assembly 233 and closure member 231 as also indicated by arrows in FIG. 29. More specifically, flexure of the side wall 289 of the second elliptical tubular plug 265 caused by vacuum pressure at or below the threshold pressure breaks the vertical extending seal and allows liquid within the container 203 to pass between the side wall of the second elliptical tubular plug 265 and the second elliptical socket 255 of the closure member 231. Thus, the user applying vacuum to the spout 246 at or above the threshold vacuum permits liquid to flow past the valve assembly 233 and the closure member 231 and into the suction chamber 311. More specifically, liquid is able to flow into either end of the transverse passageway 244 of the spout 246, through the longitudinal passageway 274, and out the opening 249 into the user's mouth for drinking.

The amount of vacuum pressure (applied by the user sucking on the spout 246) needed to configure the valve assembly 233 from the sealed (or closed) configuration to its unsealed (or opened) configuration can be predetermined. Suitably, the amount of vacuum pressure needed to move the valve assembly 233 between the sealed and unsealed position is less than 5 inches of mercury. In one suitable embodiment, the amount of vacuum pressure needed to move the valve assembly 233 between the sealed and unsealed position is between 2 inches of mercury and 5 inches of mercury. In the illustrated embodiment, for example, the amount of vacuum pressure needed to move the valve assembly 233 between the sealed and unsealed position is about 3 inches of mercury.

FIG. 30 is a perspective cross-section of the valve assembly 233 in isolation without any other components of the cup 201 being seen. The valve assembly 233 and, more specifically, the second elliptical tubular plug 265 is illustrated being acted on by vacuum pressure applied to the interior chamber 291 of the second elliptical tubular plug. As seen therein, the portion of the side wall 289 having the minimum thickness T4 flexes inward toward the major axis MA1 of the second elliptical tubular plug 265. More specifically, the portion of the side wall 289 having the minimum thickness T4 flexes a greatest extent along the minor axis MA2 of the second elliptical tubular plug 265 and near the uppermost extent of the side wall as viewed in FIG. 30. This point or area defines a maximum deflection MD of the second elliptical tubular plug 265. The extent or amount that the side wall 289 flexes tapers or lessens in all radial direction away from the maximum deflection MD. In the illustrated embodiment, the side wall 289 hinges along the major axis MA1 of the second elliptical tubular plug 265 such that about half of the second elliptical tubular plug (i.e., the half having the minimum thickness T4) flexes or is otherwise deformed. The portion of the side wall 289 having the maximum thickness T3 is sufficiently rigidified by the additional thickness such that the applied vacuum is insufficient to break the seal formed between outer surface of the portion of the side wall having the maximum thickness and the inner surface of the second elliptical tubular plug 265. As illustrated in FIG. 30, the half of the second elliptical tubular plug 265 having the side wall 289 with the maximum thickness T3 is not deflected or otherwise deformed. It is understood that the second elliptical tubular plug 265 can be configured to flex or otherwise deform a greater or lesser extent without departing from some aspects of this disclosure.

Once the user stops applying a vacuum pressure to the spout 246, the resiliency (or elasticity) of the valve assembly 233 causes the valve assembly to move from the unsealed position back to the sealed position. More specifically, terminating the vacuum pressure applied to the interior chamber 291 of the second elliptical tubular plug 265 results in the side wall 289 moving away from the major axis A1 of the second elliptical tubular plug and toward its prior position. As the side wall 289 moves back to its rest position, the vertical extending seal formed between the outer surface of the second elliptical tubular plug 265 and the inner surface of the second elliptical socket 257 is reestablished to close the pathway between the valve assembly 233 and the closure member 231 and inhibit liquid from passing the valve assembly. Thus, the user by stopping to apply vacuum to the spout 246 causes the valve assembly 233 to return to its closed, sealed position and inhibits liquid from flowing past the valve assembly 233 into the passageway 274 of the spout.

As liquid is drawn out of the container 203 by the child, the pressure within the liquid chamber of the container is reduced. Upon reaching a threshold vacuum pressure within the liquid chamber of the container 203, the side wall 283 of the first elliptical tubular plug 263 having the minimum thickness T2 deflects thereby opening the vertical extending seal thereby allowing ambient air to pass between the inner surface of the side wall and the outer surface of the first elliptical socket 255 through the cutout 260 in the first elliptical socket, the aperture 241 in the closure member 231, and enter into the vent chamber 309 (see, e.g., FIG. 29). Thus, from the vent chamber 309, ambient air passes between the valve assembly 233 and the closure member 231 to bring the pressure within the liquid chamber to or approximately to ambient. Once the vacuum pressure within the liquid chamber of the container 203 returns approximately to ambient, the vertical seal between the inner surface of the side wall 283 of the first elliptical tubular plug 263 and the outer surface of the first elliptical socket 255 is reestablished or returned to the sealed position inhibiting air from flowing into the chamber.

The illustrated drinking cup 201 can be repeatedly taken apart for thorough cleaning and reassembled for the next use. The separable components are all relatively large so that they are easy to handle. In addition, the number of separable components is minimized to make assembly and reassembly of the cup 201 relatively easy without compromising the ability to clean each of the components. As mentioned above, the closure member 231, in the illustrated embodiment, can be removed from or secured to the container 203 via its threaded connection therewith. That is, the internal threads 253 of the inner socket 251 of the closure member 231 can be selectively engaged with and disengaged from the external threads on the attachment collar of the container 203. As noted above, it is understood that other forms and structures for making a releasable connection between the closure member 231 and the container 203 may be used. For instance, the closure member 231 may have a snap-fit connection with the container 203.

The valve assembly 233 can be selectively inserted into and pulled off of the closure member 231. More particularly, the valve assembly 233 can be releasibly coupled to the closure member 231 by engaging the first elliptical tubular plug 263 of the valve assembly with the first elliptical sockets 255 of the closure member, and the second elliptical tubular plug 265 of the valve assembly with the second elliptical socket 257 of the closure member. Thus, in the illustrated embodiment, the valve assembly 233 has a friction fit (or interference fit) with the closure member 231. To remove the valve assembly 233 from the closure member 231, a user grabs the valve assembly and pulls downward to disengage the first elliptical tubular plug 263 of the valve assembly from the first elliptical sockets 255 of the closure member, and the second elliptical tubular plug 265 of the valve assembly from the second elliptical socket 257.

When introducing elements of the present invention or the various versions, embodiment(s) or aspects thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above without departing from the scope of the invention, it is intended that all matter contained in the above description and shown in the accompanying drawings shall be interpreted as illustrative and not in a limiting sense.

What is claimed is:

1. A lid assembly for a leak resistant drinking cup, the lid assembly comprising:

a closure member including a socket in fluid communication with a liquid passageway, the socket having a wall with a cutout therein, a valve assembly including a plug adapted for insertion into the socket of the closure member to form a seal between the socket and the plug, the plug having a base, a side wall, and an interior chamber cooperatively defined by the base and the side wall, the seal formed between the plug and socket being selectively moveable from a sealed configuration wherein the plug inhibits fluid communication between the cutout in the socket and the liquid passageway to an unsealed configuration by vacuum pressure being applied to the interior chamber of the plug above a threshold value, wherein application of vacuum pressure above the threshold value causes a portion of the side wall of the plug to flex away from the socket to allow fluid to pass along and contact an exterior surface of the side wall, thereby opening fluid communication between the cutout in the socket and the liquid passageway.

2. The lid assembly as set forth in claim 1 wherein the side wall of the plug cooperates with the wall of the socket to form a vertical extending seal.

3. The lid assembly as set forth in claim 1 wherein the side wall has a maximum thickness and a minimum thickness, the portion of the side wall of the plug with the minimum thickness being disposed adjacent the cutout in the plug when the plug is inserted into the socket, a ratio between the minimum thickness of the side wall of the plug and the maximum thickness of the side wall is between 1 and 12.

4. The lid assembly as set forth in claim 3 wherein the ratio between the minimum thickness of the side wall of the plug and the maximum thickness of the side wall is between 1.25 and 2.25.

5. The lid assembly as set forth in claim 1 wherein the wall of the socket has a height, the cutout in the wall extending less than the entire height of the wall.

6. A leak resistant drinking cup comprising a container and the lid assembly set forth in claim 1, the lid assembly being selectively attachable to and detachable from the container.

7. A lid assembly for a leak resistant drinking cup, the lid assembly comprising:

a closure member comprising a first elliptical socket having a wall with a cutout therein, a second elliptical socket having a wall with a cutout therein, the second elliptical socket being spaced from the first elliptical socket, a vent aperture in fluid communication with the first elliptical socket, and a liquid passageway in fluid communication with the second elliptical socket a valve assembly comprising a first tubular plug adapted to couple to and form a seal with the first elliptical socket of the closure member, the first tubular plug including a base and a side wall extending up from the base, the base and the side wall cooperatively defining an interior chamber of the first tubular plug, the seal formed between the first tubular plug and the first elliptical socket being moveable between a sealed configuration and an unsealed configuration by movement of a portion of the side wall of the first tubular plug away from the cutout in the first elliptical socket, a second tubular plug adapted to couple to and form a seal with the second elliptical socket of the closure member, the second tubular plug including a base and a side wall extending up from the base, the base and the side wall cooperatively defining an interior chamber of the second tubular plug, the seal formed between the second tubular plug and the second elliptical socket being moveable between a sealed configuration and an unsealed configuration by movement of a portion of the side wall of the second tubular plug away from the cutout in the second elliptical socket, wherein the first elliptical socket is sized and shaped relative to the first tubular plug such that the first elliptical socket is received within the interior chamber of the first tubular plug.

8. The lid assembly as set forth in claim 7 wherein the seal formed between the first tubular plug and the first elliptical socket is moveable between the sealed configuration and the unsealed configuration by flexing of the portion of the side wall of the first tubular plug outward away from the cutout in the first elliptical socket.

9. The lid assembly as set forth in claim 7 wherein the second elliptical socket is sized and shaped relative to the second tubular plug such that the second tubular plug is received within second elliptical socket.

10. The lid assembly as set forth in claim 9 wherein the seal formed between the second tubular plug and the second elliptical socket is moveable between the sealed configuration and the unsealed configuration by flexing of the portion of the side wall of the second tubular plug inward away from the cutout in the first elliptical socket.

11. The lid assembly as set forth in claim 7 wherein each of the first and second tubular plugs is free of slits or cuts.

12. The lid assembly as set forth in claim 7 wherein the second tubular plug is a mirror image of the first tubular plug such that the first tubular plug can be selectively engaged with either the first elliptical socket or the second elliptical socket, and the second tubular plug can be selectively engaged with the other one of the first and second elliptical sockets.

13. The lid assembly as set forth in claim 7 wherein the seal formed between the first tubular plug and the first elliptical socket is a vertical seal.

14. The lid assembly as set forth in claim 7 wherein the seal formed between the second tubular plug and the second elliptical socket is a vertical seal.

15. A leak resistant drinking cup comprising a container and the lid assembly set forth in claim 7, the lid assembly being selectively attachable to and detachable from the container.

16. A leak resistant drinking cup comprising:

a container adapted to hold liquid and a lid assembly selectively attachable to and detachable from the container, the lid assembly comprising:

a closure member including a socket in fluid communication with a liquid passageway, a valve assembly including a plug adapted for insertion into the socket of the closure member to form a vertical seal between the socket and the plug, the plug having a base, a side wall, and an interior chamber cooperatively defined by the base and the side wall, the vertical seal formed between the plug and socket being selectively moveable from a sealed configuration wherein the plug inhibits fluid communication between the container and the liquid passageway to an unsealed configuration by vacuum pressure being applied to the interior chamber of the plug above a threshold value, wherein application of vacuum pressure above the threshold value causes a portion of the side wall of the plug to flex away from the socket thereby opening the vertical seal to allow fluid communication between the container and the liquid passageway.

17. The leak resistant drinking cup set forth in claim 16 wherein the closure member comprises a spout, at least a portion of the liquid passageway being disposed within the spout.

18. The leak resistant drinking cup set forth in claim 16 wherein the valve assembly comprises a spout, at least a portion of the liquid passageway being disposed within the spout.

19. A valve assembly for a leak resistant drinking cup comprising:

a first tubular plug adapted to couple to and form a seal with a first socket of the drinking cup, the first tubular plug including:

a base, and a side wall extending up from the base, the base and the side wall cooperatively defining an interior chamber of the first tubular plug radially inward of the side wall, the side wall being moveable between a sealed configuration and an unsealed configuration by movement of a portion of the side wall of the first tubular plug radially outward, a second tubular plug adapted to couple to and form a seal with a second socket of the drinking cup, the second tubular plug including:

a base, and a side wall extending up from the base, the base and the side wall cooperatively defining an interior chamber of the second tubular plug radially inward of the side wall, the side wall being moveable between a sealed configuration and an unsealed configuration by movement of a portion of the side wall of the second tubular plug radially inward, wherein the valve assembly is free of slits and cuts.

* * * * *